US008243105B2

(12) United States Patent
Tomizawa et al.

(10) Patent No.: US 8,243,105 B2
(45) Date of Patent: Aug. 14, 2012

(54) DISPLAY DEVICE, DISPLAY DEVICE ADJUSTMENT METHOD, IMAGE DISPLAY MONITOR, AND TELEVISION RECEIVER

(75) Inventors: Kazunari Tomizawa, Kizugawa (JP); Tomohiko Mori, Tenri (JP); Shinji Horino, Kishiwada (JP); Makoto Shiomi, Tenri (JP)

(73) Assignee: Sharp Kabushiki Kaisha, Osaka-Shi, Oska (JP)

( * ) Notice: Subject to any disclaimer, the term of this patent is extended or adjusted under 35 U.S.C. 154(b) by 1421 days.

(21) Appl. No.: 11/795,719

(22) PCT Filed: Mar. 10, 2006

(86) PCT No.: PCT/JP2006/304797

§ 371 (c)(1),
(2), (4) Date: Jul. 20, 2007

(87) PCT Pub. No.: WO2006/098247

PCT Pub. Date: Sep. 21, 2006

(65) Prior Publication Data

US 2008/0024409 A1 Jan. 31, 2008

(30) Foreign Application Priority Data

Mar. 15, 2005 (JP) ..... 2005-073975
Nov. 4, 2005 (JP) ..... 2005-321508

(51) Int. Cl.
*G09G 5/10* (2006.01)
*G09G 3/36* (2006.01)

(52) U.S. Cl. ..... 345/690; 345/88

(58) Field of Classification Search ..... 345/87–107, 345/204–215, 690–699
See application file for complete search history.

(56) References Cited

U.S. PATENT DOCUMENTS 5,606,437 A * 2/1997 Mosier ..... 349/106
7,375,773 B2 * 5/2008 Kurihara et al. ..... 349/38
(Continued)

FOREIGN PATENT DOCUMENTS

JP 2001-296841 10/2001
(Continued)

OTHER PUBLICATIONS

International Search Report PCT/ISA/210.
(Continued)

*Primary Examiner* — Amare Mengistu
*Assistant Examiner* — Patrick F Marinelli
(74) *Attorney, Agent, or Firm* — Harness, Dickey & Pierce, P.L.C.

(57) ABSTRACT

The display device of an embodiment of the present invention includes a display section which includes a pixel having a plurality of sub pixels and displays an image whose luminance is based on a luminance gradation of an inputted display signal, wherein the display section is arranged so that an integral value obtained by carrying out the following steps (a) to (d) is not more than 0.0202, the step (a) of measuring surface luminance of the display section and oblique luminance of the display section viewed at 60° from a front direction of the display section, the step (b) of standardizing the front luminance and the oblique luminance so as to calculate front standardized brightness x and oblique standardized brightness, the step (c) of determining n of x^(n/2.2) so that an integral value of a difference between x^(n/2.2) and the front standardized brightness x is equal to an integral value of a difference between the oblique standardized brightness and the front standardized brightness x, the step (d) of integrating an absolute value of a difference between x^(n/2.2) and the oblique standardized brightness, from minimum luminance to maximum luminance of the front standardized brightness x, so as to obtain an integral value.

14 Claims, 19 Drawing Sheets

U.S. PATENT DOCUMENTS

| | | | | |
|---|---|---|---|---|
| 2002/0047822 | A1* | 4/2002 | Senda et al. | 345/90 |
| 2003/0146893 | A1 | 8/2003 | Sawabe | |
| 2003/0227429 | A1 | 12/2003 | Shimoshikiryo | |
| 2004/0001167 | A1 | 1/2004 | Takeuchi et al. | |
| 2004/0135147 | A1 | 7/2004 | Kim et al. | |
| 2004/0239698 | A1 | 12/2004 | Kamada et al. | |

FOREIGN PATENT DOCUMENTS

| | | |
|---|---|---|
| JP | 2003-295160 | 10/2003 |
| JP | 2004-62146 | 2/2004 |
| JP | 2004-78157 | 3/2004 |
| JP | 2004-213011 | 7/2004 |
| JP | 2004-258139 | 9/2004 |
| JP | 2004-302270 | 10/2004 |

OTHER PUBLICATIONS

PCT Form PCT/IB/304.
PCT Request PCT/RO/101.
Written Opinion PCT/ISA/237.

* cited by examiner

Va=Vd*Cdcea/(Cdcea+Clca)
Vb=Vd*Cdceb/(Cdceb+Clcb)

DISPLAY DEVICE, DISPLAY DEVICE ADJUSTMENT METHOD, IMAGE DISPLAY MONITOR, AND TELEVISION RECEIVER

TECHNICAL FIELD

The present invention relates to a display device in which each pixel of a display section is divided into a plurality of sub pixels.

BACKGROUND ART

Recently, in a field where CRT (cathode ray tube) had been conventionally used, a liquid crystal display device, particularly, a color liquid crystal display device having a vertically aligned (VA) mode liquid crystal display panel (VA mode liquid crystal panel: VA panel) has been widely used.

According to an area division pixel driving mode, it is possible to improve lateral visibility by adjusting an area ratio of sub pixels and a luminance ratio between the sub pixels. An example of a conventional liquid crystal display device adopting such a driving mode is a liquid crystal display device arranged so as to adjust an area in which a capacitance generated between a direction control electrode and a first pixel electrode and a capacitance generated between the direction control electrode and a second pixel electrode are superimposed, thereby causing the capacitance between the direction control electrode and the second pixel electrode to be higher than the capacitance between the direction control electrode and the first pixel electrode (see Patent Document 1). According to the liquid crystal display device described in Patent Document 1, it is possible to suppress excess brightness in halftone luminance to some extent in case where a panel is viewed from a front direction (viewing angle is 0).

Patent Document 1: Japanese unexamined Patent Publication No. 213011/2004 (Tokukai 2004-213011) (Publication date: Jul. 29, 2004)

DISCLOSURE OF INVENTION

However, according to the liquid crystal display device described in Patent Document 1, inflection in the viewing angle property becomes greater, so that a luminance ratio of displayed colors which are different from each other in luminance varies between a front direction and a lateral direction. This results in color deviation. That is, in the liquid crystal display device adopting the conventional area division pixel driving mode, as shown in a graph of FIG. 29, a difference between expected luminance indicated by a continuous line and actual luminance indicated by a dotted line varies depending on luminance (this is apparent from comparison between the front luminance of 0.20 and 0.50 for example). In this way, according to the conventional liquid crystal display device, although it is possible to improve the excess brightness to some extent, the liquid crystal display device has such a problem that inflection in the viewing angle property causes color deviation. From this view point, further improvement is desired.

The present invention was made in view of the foregoing problems, and an object of the present invention is to provide a display device in which color deviation is suppressed.

In order to solve the foregoing problems, a display device of the present invention includes: a display section which includes a pixel having a first sub pixel and a second sub pixel and displays an image whose luminance is based on a luminance gradation of an inputted display signal; and a control section which causes luminance of the first sub pixel and luminance of the second sub pixel to be different from each other and generates a first display signal serving as a display signal in a first sub frame and a second display signal serving as a display signal in a second sub frame so that division of a frame does not change total luminance outputted from the display section in a single frame, so as to output the first and second display signal to the display section, wherein the display section is arranged so that an integral value obtained by carrying out steps (a) to (d) is not more than 0.0202, the step (a) of measuring surface luminance of the display section and oblique luminance of the display section viewed at an angle of 60° with respect to a front direction of the display section, the step (b) of standardizing the front luminance and the oblique luminance so as to calculate front standardized brightness x and oblique standardized brightness, the step (c) of determining n of $x^{(n/2.2)}$ so that an integral value of a difference between $x^{(n/2.2)}$ and the front standardized brightness x is equal to an integral value of a difference between the oblique standardized brightness and the front standardized brightness x, the step (d) of integrating an absolute value of a difference between $x^{(n/2.2)}$ and the oblique standardized brightness, from minimum luminance to maximum luminance of the front standardized brightness x, so as to obtain an integral value.

The integral value is based on inflection in the viewing angle property obtained by plotting the oblique standardized brightness with respect to the front standardized brightness x. By setting the integral value to not more than 0.0202, it is possible to suppress the color deviation of the display section.

Further, by setting the integral value to not more than 0.015, it is possible to suppress the color deviation to the acceptability limit. Further, by setting n, obtained in the step (c), to not less than 1.75, it is possible to suppress the excess brightness to the acceptability limit.

The display device of the present invention uses the display section having a display screen such as a liquid crystal panel so as to display an image.

Further, the present display device is arranged so that the control section drives the display section by carrying out sub frame display. Herein, the sub frame display is a display method in which a single frame is divided into a plurality of sub frames (m number of sub frames (first to m-th sub frames) in the present display device).

That is, the control section outputs a display signal to the display section m times in a single frame (the control section sequentially outputs first to m-th display signals respectively serving as display signals in the first to m-th sub frames). As a result, the control section turns ON all gate lines of the display screen of the display section once in each sub frame period (the control section turns ON the gate lines M times in a single frame).

Further, it is preferable that the control section multiplies an output frequency (clock) of the display signal at the time of normal hold display by m (m-fold clock).

Note that, the normal hold display is normal display which carried out without dividing a frame into any sub frames (display carried out by turning ON all the gate lines of the display screen only once in a single frame).

Further, the display section (display image) is designed so as to display an image whose luminance is based on a luminance gradation of the display signal inputted from the control section. The control section divides a frame so as to generate the first to m-th display signals without changing total of luminance (entire luminance) outputted from the screen (so as to set luminance gradations of these display signals) in a single frame.

Generally, in case of arranging the display screen of the display section so that the luminance gradation is "a minimum value or a value lower than a first predetermined value" or "a maximum value or a value higher than a second predetermined value", the deviation (brightness deviation) between the actual brightness and the expected brightness is sufficiently reduced.

Herein, in case of setting the luminance gradation to the minimum or the maximum, it is natural that the brightness deviation can be reduced. However, in substance, merely by setting the luminance gradation to be approximate to the minimum or the maximum (not more than 0.02% or not less than 80% of the maximum for example), it is possible to obtain the same effect.

Herein, the brightness refers to a degree of brightness which corresponds to luminance of a displayed image and can be sensed by human eyes (see expressions (5) and (6) in a below-described Example). Note that, in case where the total luminance outputted in a single frame does not change, also total brightness outputted in a single frame does not change.

The expected brightness is brightness which should be outputted in the displayed image (a value corresponding to the luminance gradation of the display signal).

The actual brightness is brightness which is actually outputted and is a value which varies according to a viewing angle. In front of the screen, the actual brightness and the expected brightness are equal to each other without any brightness deviation. As the viewing angle becomes greater, also the brightness deviation becomes greater.

In the present display device, when displaying an image, the control section sets a luminance gradation of at least one of the first to m-th display signals to "a minimum value or a value lower than the first predetermined value" or "a maximum value or a value higher than a second predetermined value" and adjusts a luminance gradation of other display signal so as to carry out gradation expression.

Thus, it is possible to sufficiently reduce the brightness deviation at least in a single sub frame. As a result, in the present display device, the brightness deviation can be made smaller than the case of carrying out the normal hold display, so that it is possible to improve the viewing angle property.

Generally, in case where the brightness (and luminance) of the image is minimum or maximum, the display screen of the display section can make the deviation between the actual brightness and the expected brightness minimum (0) at a great viewing angle. Thus, it is preferable that the control section sets a luminance gradation of at least one of the first to m-th display signals to be minimum or maximum and adjusts a luminance gradation of other display signal so as to carry out gradation expression. As a result, it is possible to minimize the brightness deviation in at least one sub frame, thereby further improving the viewing angle property.

A method of the present invention for adjusting a display device which includes: a display section which includes a pixel having a first sub pixel and a second sub pixel and displays an image whose luminance is based on a luminance gradation of an inputted display signal; and a control section which causes luminance of the first sub pixel and luminance of the second sub pixel to be different from each other and generates a first display signal serving as a display signal in a first sub frame and a second display signal serving as a display signal in a second sub frame so that division of a frame does not change total luminance outputted from the display section in a single frame, so as to output the first and second display signal to the display section, said adjustment method comprising the steps of: measuring surface luminance of the display section and oblique luminance of the display section viewed at 60° from a front direction of the display section; standardizing the front luminance and the oblique luminance so as to calculate front standardized brightness x and oblique standardized brightness; determining n of $x^{\wedge}(n/2.2)$ so that an integral value of a difference between $x^{\wedge}(n/2.2)$ and the front standardized brightness x is equal to an integral value of a difference between the oblique standardized brightness and the front standardized brightness x; and integrating an absolute value of a difference between $x^{\wedge}(n/2.2)$ and the oblique standardized brightness, from minimum luminance to maximum luminance of the front standardized brightness x, so that an integral value obtained by the integration is not more than 0.0202.

In the display device and the adjustment method of the present invention, the adjustment for setting the integral value to not more than 0.0202 can be carried out by adjusting an area ratio of the first and second sub pixels and distribution of a signal to the first and second sub pixels, by adjusting a ratio of sub frames obtained by division carried out by the control section, or by carrying out a similar process.

Further, by combining the display device with a signal input section for transmitting an image signal inputted from an outside to the image display device, it is possible to constitute a liquid crystal monitor used in a personal computer or the like.

Also, by combining the display device with a tuner section, it is possible to constitute a liquid crystal television receiver.

The display device of the present invention may be arranged so that: the control section adjusts a luminance gradation of the first display signal and sets a luminance gradation of the second display signal to be minimum or to be lower than the first predetermined value in case of displaying an image whose brightness is low, and the control section sets the luminance gradation of the first display signal to maximum or higher than the second predetermined value and adjusts the luminance gradation of the second display signal in case of displaying an image whose brightness is high.

The control section of the display device arranged in the foregoing manner adjusts the luminance of the first display signal and the second display signal differently in accordance with whether an image whose brightness is low or an image whose brightness is high is to be displayed, so that it is possible to suppress the pixel luminance difference between the case where the image is viewed from a front direction and the case where the image is viewed from an oblique direction. As a result, it is possible to realize the display device whose display section has little color deviation.

As described above, the display device according to the present invention includes the display section whose integral value obtained in the aforementioned steps (a) to (d) is not more than 0.202, so that the luminance difference between the case where the display section is viewed from a front direction and the case where the display section is viewed from an oblique direction, thereby suppressing the color deviation.

Additional objects, features, and strengths of the present invention will be made clear by the description below. Further, the advantages of the present invention will be evident from the following explanation in reference to the drawings.

BRIEF DESCRIPTION OF DRAWINGS

FIG. 9(*b*) is a graph illustrating a voltage (liquid crystal voltage) applied to the liquid crystal capacitor of the sub pixel in case where a negative (≦Vcom) display signal is applied to the source line S.

FIG. 9(*c*) is a graph illustrating a voltage (liquid crystal voltage) applied to the liquid crystal capacitor of the sub pixel in case where a positive (≧Vcom) display signal is applied to the source line S.

FIG. 9(*d*) is a graph indicative of a voltage (liquid crystal voltage) applied to the liquid crystal capacitor of the sub pixel in case where a negative (≦Vcom) display signal is applied to the source line S.

FIG. 14(*b*) is a diagram schematically illustrating the positional relation between the display section and the luminometer in measuring the viewing angle property, and illustrates the positional relation viewed from a front direction with respect to the display section.

FIG. 14(*c*) is a diagram schematically illustrating the positional relation between the display section and the luminometer in measuring the viewing angle property, and illustrates the positional relation viewed from a lateral direction with respect to the display section.

BEST MODE FOR CARRYING OUT THE INVENTION

The following description explains one embodiment of the present invention with reference to the drawings.

[Adjustment of First and Second Display Signals]

A liquid crystal display device (present display device) according to the present embodiment has a vertically aligned (VA) mode liquid crystal panel which is divided into plural domains.

Further, the present display device functions as a liquid crystal monitor which causes a liquid crystal panel to display an image based on an image signal inputted from the outside.

Figure 1:
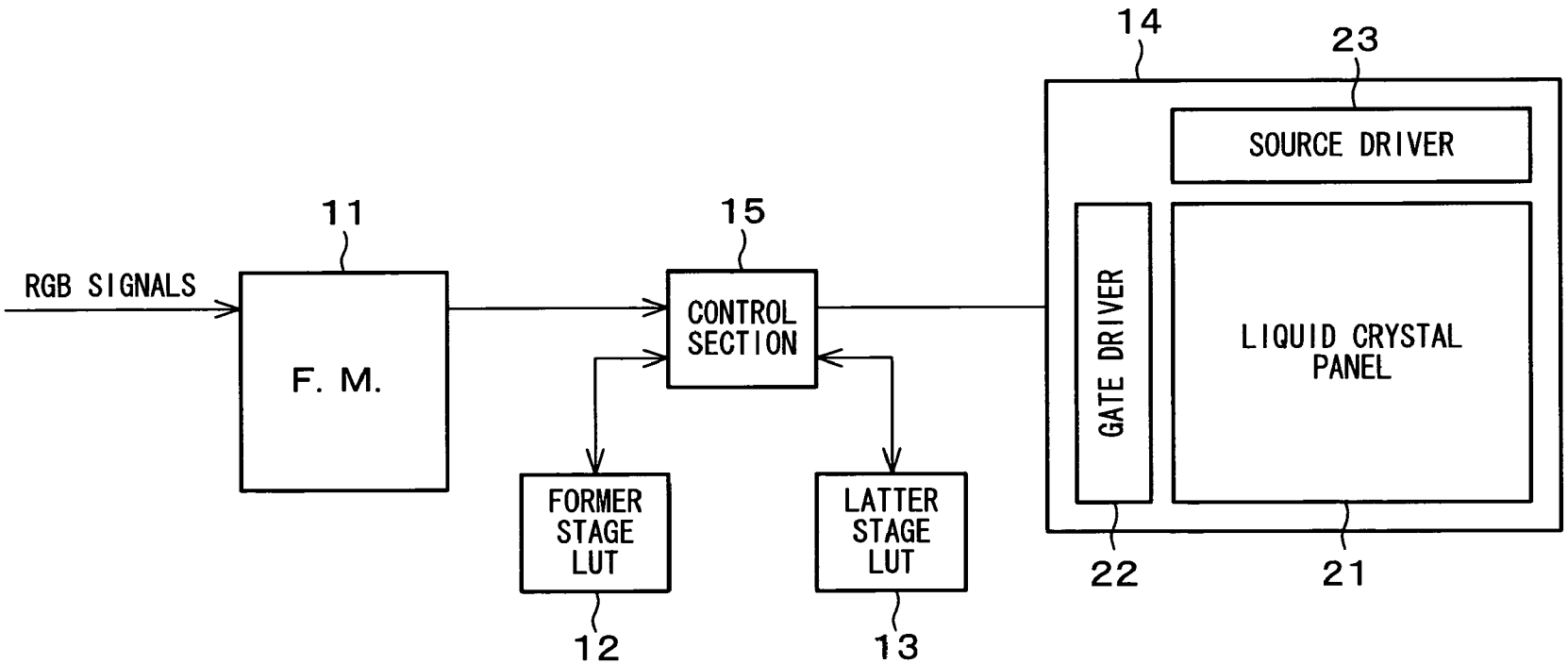
FIG. 1 is a block diagram illustrating an arrangement of a display device according to one embodiment of the present invention.

FIG. 1 is a block diagram illustrating an internal structure of the display device.

As illustrated in FIG. 1, the display device includes a frame memory (F.M.) 11, a former stage LUT 12, a latter stage LUT 13, a display section 14, and a control section 15.

The frame memory (image signal input section) 11 stores therein image signals (RGB signals) which are inputted from an external signal source and correspond to a single frame.

Each of the former stage LUT (look-up table) 12 and the latter stage LUT 13 is a relation table (conversion table) indicative of a relation between an image signal inputted from the outside and a display signal outputted to the display section 14.

Note that, the display device carries out sub frame display. The sub frame display is a method in which a single frame is divided into a plurality of sub frames so as to carry out display.

That is, the display device is designed so that: based on image signals which are inputted in a single frame period so as to correspond to a single frame, the display device carries out display at a double frequency with two sub frames whose sizes (periods) are equal to each other.

Further, the former stage LUT 12 is a relation table for a display signal (former stage display signal; second display signal) outputted in a former stage sub frame (former sub frame; second sub frame). While, the latter stage LUT 13 is a relation table for a display signal (latter stage display signal; first display signal) outputted in a latter stage sub frame (latter sub frame; first sub frame).

As illustrated in FIG. 1, the display section 14 includes a liquid crystal panel 21, a gate driver 22, and a source driver 23, and displays an image based on the inputted display signal.

The liquid crystal panel 21 is a VA mode active matrix (TFT) liquid crystal panel.

The control section 15 serves as a central portion of the display device by controlling entire operations of the display device. Further, the control section 15 uses the former stage LUT 12 and the latter stage LUT 13 so as to generate a display signal from an image signal stored in the frame memory 11, and outputs the generated display signal to the display section 14.

That is, the control section 15 stores the image signal, which is sent at a normal output frequency (normal clock; 25 MHz for example), into the frame memory 11. The control section 15 outputs the image signal from the frame memory 11 twice at a clock (double clock; 50 MHz) having a frequency twice as high as a normal clock.

Further, based on the first outputted image signal, the control section 15 generates a former stage display signal by using the former stage LUT 12. Thereafter, based on the second outputted image signal, the control section 15 generates a latter stage display signal by using the latter stage LUT 13. Further, these display signals are sequentially outputted to the display section 14 at a double clock.

As a result, based on the two display signals sequentially inputted, the display section 14 displays images different from each other so that each of the images is displayed once (all the gate lines of the liquid crystal panel 21 are turned ON once in each of both the sub frame periods).

Note that, the operation for outputting the display signals will be further detailed later.

The following explains how the control section 15 generates the former stage display signal and the latter stage display signal.

First, general display luminance of the liquid crystal panel (luminance of an image displayed by the panel) will be described later.

In case of displaying an image of normal 8-bit data at a single frame without using any sub frame (in case of carrying out normal hold display in which all the gate lines of the liquid crystal panel are turned ON only once in a single frame period), a display signal luminance gradation (signal gradation) ranges from 0 to 255.

Further, the signal gradation and the display luminance of the liquid crystal panel are expressed by the following expression (1) in an approximate manner.

$$((T-T0)/(T\max-T0))=(L/L\max)^{\gamma} \quad (1)$$

where L represents a signal gradation (frame gradation) in case of displaying an image in a single frame (in case of displaying an image in a normal hold display mode), Lmax represents a maximum luminance gradation (255), T represents display luminance, Tmax represents maximum luminance (luminance at the time of L=Lmax=255; white), T0 represents minimum luminance (luminance at the time of L=0; black), and γ represents a corrected value (normally, 2.2).

Note that, in the actual liquid crystal panel 21, T0 is not equal to 0. However, for simplification of explanation, the arrangement will be described on the assumption that T0=0.

Figure 2:
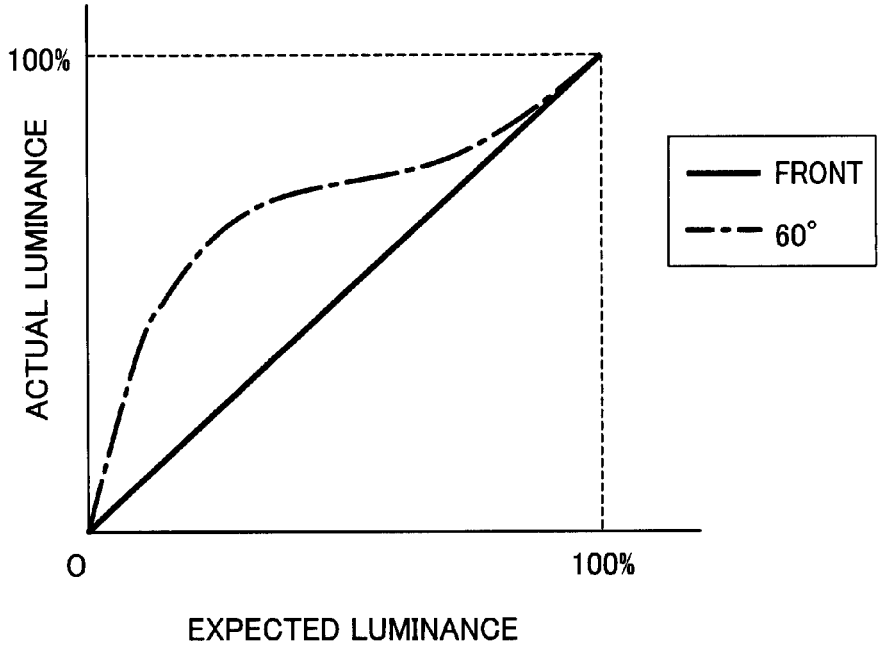
FIG. 2 is a graph illustrating display luminance (relation between expected luminance and actual luminance) outputted from a liquid crystal panel in case of normal hold display.

Further, the display luminance T outputted from the liquid crystal panel 21 in this case (in case of the normal hold display) is illustrated in FIG. 2 as a graph. In the graph, a horizontal axis indicates "luminance which should be outputted (expected luminance; a value according to the signal gradation, corresponding to the display luminance T)" and a vertical axis indicates "luminance actually outputted (actual luminance)".

In this case, as illustrated by the graph, the expected luminance and the actual luminance are equal to each other in a front direction (the viewing angle is 0) with respect to the liquid crystal panel 21. While, when the viewing angle is 60°, the actual luminance becomes higher in the halftone luminance due to variation of the gradation γ property.

Next, the display luminance of the display device is illustrated as follows.

In the display device, the control section 15 is designed so as to carry out gradation expression as follows:

(a) "a total (integral luminance in a single frame) of luminance (display luminance) of an image displayed by the display section 14 in a former sub frame and a latter sub frame is made equal to display luminance in a single frame in case of carrying out normal hold display" and (b) "one of the sub frames is made black (minimum luminance) or white (maximum luminance)".

Thus, in the display device, the control section 15 is designed so that a frame is equally divided into two sub frames so as to display luminance half of the maximum in a single sub frame.

That is, in case of outputting luminance (threshold luminance; Tmax/2) half of the maximum luminance in a single frame (in case of low luminance), the control section 15 causes minimum luminance (black) to be outputted in the former sub frame and adjusts only the display luminance in the latter sub frame so as to carry out gradation expression (uses only the latter sub frame so as to carry out gradation). In this case, integral luminance in a single frame is "(minimum luminance+latter sub frame luminance)/2".

Further, in case of outputting luminance higher than the threshold (in case of high luminance), the control section 15 causes maximum luminance (white) to be outputted in the latter sub frame and adjusts the display luminance in the former sub frame so as to carry out gradation expression. In this case, integral luminance in a single frame is "(former sub frame luminance+maximum luminance)/2".

Next, the following specifically explains signal gradation setting carried out with respect to the display signals (the former stage display signal and the latter stage display signal) to obtain the aforementioned display luminance. Note that, the signal gradation setting is carried out by the control section 15 illustrated in FIG. 1.

The control section 15 calculates a frame gradation corresponding to the threshold luminance (Tmax/2) by using the aforementioned expression (1). That is, a frame gradation (threshold luminance; Lt) corresponding to the display luminance is, based on the expression (1), as follows:

$$Lt=0.5\hat{}(1/\gamma)\times L\max \quad (2)$$

However, $$L\max=T\max\hat{}\gamma \quad (2a)$$

In displaying an image, the control section 15 calculates a frame gradation L in accordance with an image signal outputted from the frame memory. In case where L is not more than Lt, the control section 15 causes a luminance gradation (indicated by "F") of the former stage display signal to be minimum (0) in accordance with the previous LUT 12.

While, the control section 15 sets a luminance gradation (indicated by "R") of the latter stage display signal in accordance with the expression (1) by using the latter stage LUT 13 so that $$R=0.5\hat{}(1/\gamma)\times L \quad (3).$$

Further, in case where the frame gradation L is more than Lt, the control section 15 causes the luminance gradation R of the latter stage display signal to be maximum (255). While, the control section 15 sets, in accordance with the expression (1), the luminance gradation F of the former sub frame as follow:

$$F=(L\hat{}\gamma-0.5\times L\max\hat{}\gamma)\hat{}(1/\gamma) \quad (4).$$

Next, how the display signal is outputted in the display device is further detailed as follows. Note that, the explanation is given on the assumption that the number of pixels of the liquid crystal panel 21 is a×b. In this case, the control section 15 stores the former stage display signal for pixels (a-number of pixels) of a first gate line into the source driver 23 at a double clock.

The control section 15 causes the gate driver 22 to turn ON the first gate line so as to apply the former stage display signal to the pixels of the gate line. Thereafter, the control section 15 similarly turns ON second to b-th gate lines at a double clock while changing the former stage display signal stored into the gate line. As a result, it is possible to apply the former stage display signal to all the pixels in a half period of a single frame (½ frame period).

Further, the control section 15 carries out similar operation so as to apply the latter stage display signal to the pixels of all the gate lines in the remaining ½ frame period. As a result, the former stage display signal and the latter stage display signal are applied to each pixel so that a period of application of the former stage display signal and a period of application of the latter stage display signal are equal to each other (½ frame period).

Figure 3:
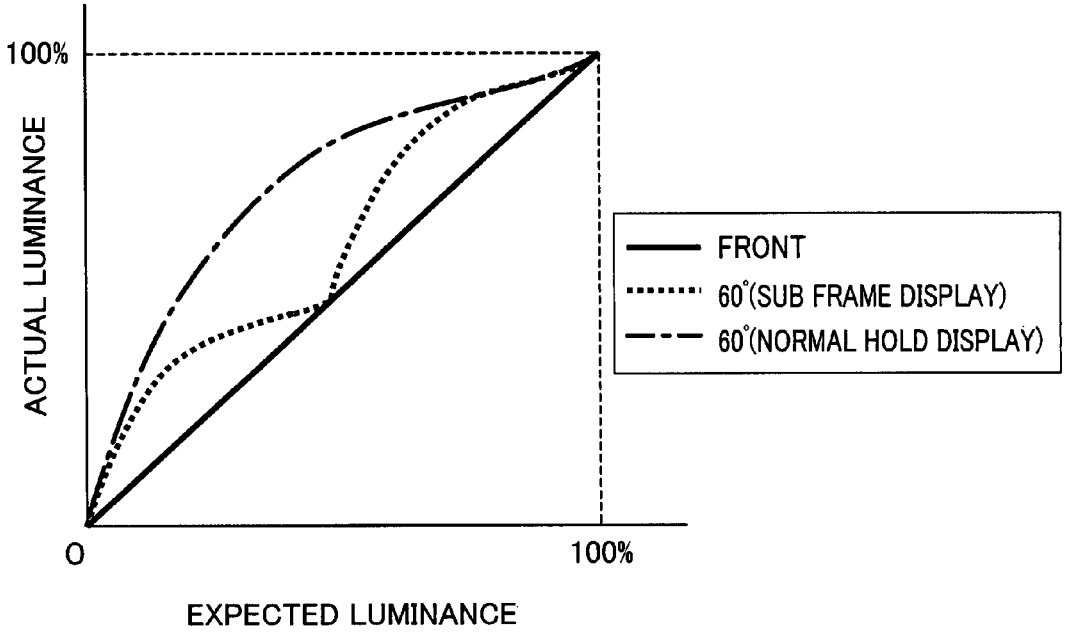
FIG. 3 is a graph illustrating display luminance (relation between expected luminance and actual luminance) outputted from a liquid crystal panel in case of carrying out sub frame display in the display device of FIG. 1.

In combination with the result (indicated by a chain line and a continuous line), FIG. 3 shows a graph illustrating a result (indicated by a dotted line and a continuous line) of sub-frame display in which the former stage display signal and the latter stage display signal are outputted respectively in the previous and latter sub frames.

As illustrated in FIG. 2, the present display device uses a liquid crystal panel 21 whose deviation between the actual luminance and the expected luminance (equal to the continuous line) in the great viewing angle is minimum (0) in case where the display luminance is maximum or minimum and is maximum in case of a halftone (vicinity of threshold luminance). Further, in the present display device, there is carried out sub frame display in which a single frame is divided into sub frames.

Further, periods of two sub frames are set to be equal to each other, and in case of low luminance, black display is carried out in the former sub frame and display is carried out only in the latter sub frame while preventing integral luminance in a single frame from varying. Thus, the deviation in the previous frame is minimum, so that it is possible to reduce total deviation in both the sub frames by half as indicated by the dotted line of FIG. 3.

While, in case of high luminance, white display is carried out in the latter sub frame and display is carried out by adjusting only luminance in the former sub frame while preventing integral luminance in a single frame from varying. Thus, also in this case, the deviation in the latter sub frame is minimum, so that it is possible to reduce total deviation in both the sub frames by half as indicated by the dotted line of FIG. 3.

In this way, the present display device allows the entire deviation to be reduced by half compared with the arrangement carrying out the normal hold display (arrangement in which an image is displayed in a single frame without using any sub frames). Thus, it is possible to suppress excess brightness in a halftone image as illustrated in FIG. 2.

Note that, in the present embodiment, the periods of the former sub frame and the latter sub frame are equal to each other. The present display device is arranged in this manner in order to display luminance half of the maximum value in a single sub frame. However, the periods of the previous and latter sub frames may be set differently from each other.

That is, the excess brightness which is a problem to be solved by the present display device is such that: the actual luminance has a characteristic shown in FIG. 2 when the viewing angle is great, so that a halftone image is excessively bright.

Note that, an image taken by a camera is normally converted into a signal based on luminance. Further, in case of transmitting the image based on a digital format, the image is converted into a signal by using γ of the expression (1) (that is, the luminance signal is multiplied by (1/γ) and the resultant is evenly divided so as to realize the gradation). Further, based on the display signal, the image displayed by the display device such as a liquid crystal panel and the like has display luminance expressed by the expression (1).

Incidentally, a human visual sense receives the image not as luminance but as brightness. Further, brightness (brightness index) M is expressed by the following expressions (5) and (6) (see Revised Chromatics Handbook, Second Edition (Shinhen Shikisaikagaku Handobukku, Dai-nihan: published by Tokyodaigaku syuppankai in 1998)).

$$M=116\times Y^{(1/3)}-16,\ Y>0.008856 \quad (5)$$

$$M=903.29\times Y,\ Y\leqq 0.008856 \quad (6)$$

where Y represents the aforementioned actual luminance and is equal to (y/yn). Note that, y is a y value of tristimulus values of an x-y-and-z color system in an arbitrary color, and yn is a y value in standard light on a perfect reflecting diffuser and yn=100.

According to these expressions, the human is likely to be sensitive to a dark image in view of the luminance and be less sensitive to a bright image in view of the luminance.

Further, it is considered that the human regards the excess brightness not as luminance deviation but as brightness deviation.

Figure 6:
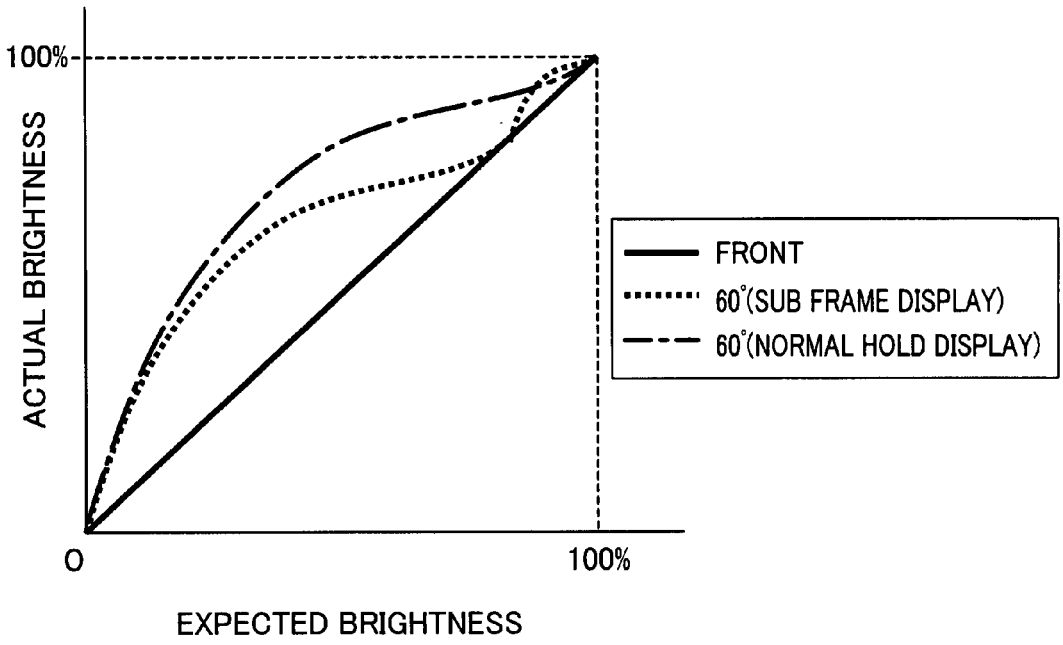
FIG. 6 is a graph obtained by converting the luminance of the graph illustrated in FIG. 3 into brightness.

FIG. 6 is a graph illustrating brightness obtained by converting the luminance of FIG. 3. In the graph, a horizontal axis indicates "brightness which should be outputted (expected brightness: a value corresponding to a signal gradation and being equal to the aforementioned brightness M) and a vertical axis indicates "brightness (actual brightness) which is actually outputted". As indicated by a continuous line of the graph, the expected brightness and the actual brightness are equal to each other in front (viewing angle is 0°) of the liquid crystal panel 21.

While, as indicated by a dotted line of the graph, in case where the viewing angle is 60° and periods of the sub frames are equal to each other (that is, in case of displaying luminance half of the maximum value in a single sub frame), deviation between the actual brightness and the expected brightness is improved compared with the conventional arrangement carrying out the normal hold display. Thus, this shows that it is possible to suppress the excess brightness to some extent.

Further, in order to more greatly suppress the excess brightness so as to be suitable for the human visual sense, it is preferable that a ratio at which the frame is divided is determined depending not on the luminance but on the brightness. Further, as in the case of the luminance, deviation between the actual brightness and the expected brightness is maximum in a half point of the maximum of the expected brightness.

Thus, it is possible to improve the deviation which can be sensed by the human (i.e., the excess brightness) not by dividing the frame so as to display luminance half of the maximum value in a single sub frame but by dividing the frame so as to display brightness half of the maximum value in a single sub frame.

The following explains a value which is preferable in a divisional point of the frame.

First, for simplification of calculation, the aforementioned expressions (5) and (6) are approximated as expressed by the following expression (6a) (similar to the expression (1)).

$$M=Y^{(1/\alpha)} \quad (6a)$$

In case of such conversion, a of the expression is generally 2.5.

Further, in order to display the brightness M half of the maximum value in a single sub frame, it is preferable that a ratio between periods of two sub frames is about 1:3 when γ=2.2. Note that, in case of dividing the frame, a sub frame used to carry out display when the luminance is low (a sub frame in which the luminance is kept highest when the luminance is high) is set as a shorter period.

The following explains the case where the ratio of the former sub frame and the latter sub frame is 3:1.

First, display luminance in this case is described as follows.

In this case, when carrying out low luminance in which ¼ luminance (threshold luminance; Tmax/4) of the maximum luminance is outputted in a single frame, the control section 15 carries out gradation expression by displaying minimum luminance (black) in the former sub frame and by adjusting only display luminance in the latter sub frame (gradation expression by using only the latter sub frame).

At this time, integral luminance in a single frame is such luminance that "(minimum luminance+luminance in the latter sub frame)/4".

Further, in case of outputting luminance higher than the threshold luminance (Tmax/4) (in case where the luminance is high), the control section 15 carries out gradation expression by displaying maximum luminance (white) in the latter sub frame and by adjusting the display luminance in the former sub frame. In this case, integral luminance in a single frame is such luminance that "(luminance in the former sub frame+maximum luminance)/4".

Next, the following specifically explains signal gradation setting carried out with respect to display signals (the former stage display signal and the latter stage display signal) for obtaining the display luminance. Note that, also in this case, the signal gradation (and below-explained output operation) are set so as to satisfy the aforementioned conditions (a) and (b).

First, the control section 15 uses the aforementioned expression (1) so as to calculate a frame gradation corresponding to the aforementioned threshold luminance (Tmax/4) in advance. That is, based on the expression (1), a frame gradation (threshold gradation; Lt) corresponding to the display luminance is as follows $$Lt=(1/4)^{(1/\gamma)}\times Lmax \quad (7).$$

Further, in displaying an image, the control section 15 calculates a frame gradation L in accordance with the image signal outputted from the frame memory 11. Further, in case where L is not more than Lt, the control section 15 uses the former stage LUT 12 so as to cause the luminance gradation (F) of the former stage display signal to be minimum (0).

While, the control section 15 uses the latter stage LUT 13 by setting the luminance gradation (R) of the latter stage display signal in accordance with the expression (1) so that $$R=(1/4)^{(1/\gamma)}\times L \quad (8).$$

Further, in case where the frame gradation L is more than Lt, the control section 15 causes the luminance gradation R of the latter stage display signal to be maximum (255). While, based on the expression (1), the control section 15 sets the luminance gradation F of the former sub frame as follows $$F=((L^{\gamma}-(1/4)\times Lmax^{\gamma}))^{(1/\gamma)} \quad (9).$$

Next, the following explains output operation of the former stage display signal and the latter stage display signal. As described above, according to the arrangement in which a frame is evenly divided, the former stage display signal and the latter stage display signal are respectively applied to the pixel for time periods equal to each other (½ frame period). This is based on the following reason: the latter stage display signal is applied after entirely applying the former stage display signal at a double clock, so that ON periods of gate lines concerning the display signals are equal to each other.

Thus, it is possible to change the division ratio by changing a start timing (gate ON timing concerning the latter stage display signal) at which application of the latter stage display signal is started.

Figure 4:
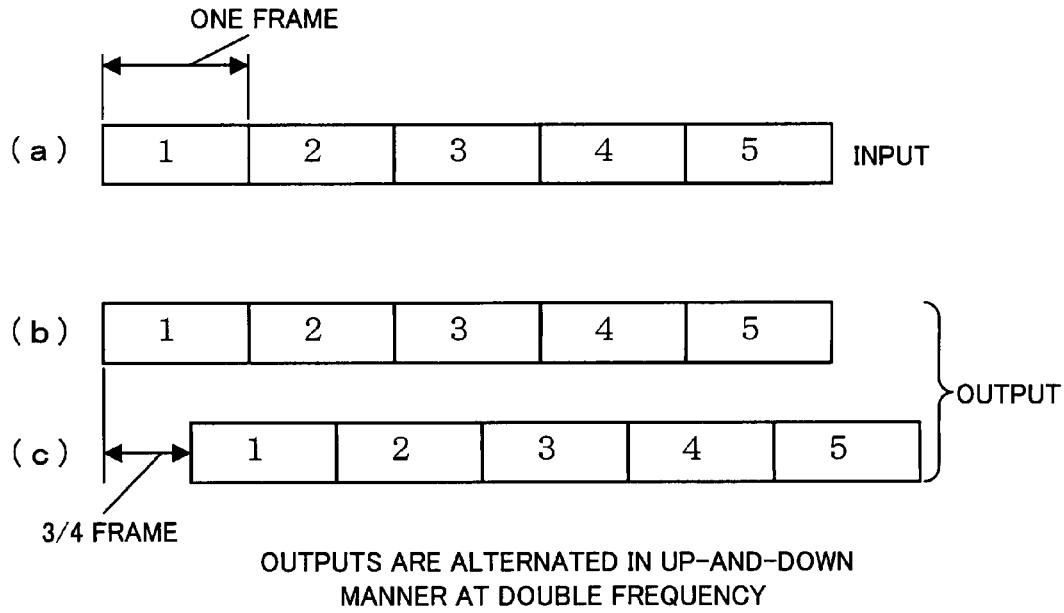
In FIG. 4, (a) illustrates an image signal inputted to a frame memory of the display device of FIG. 1. (b) illustrates an image signal outputted from the frame memory to a former stage LUT in case of dividing a frame into 3:1. (c) illustrates an image signal outputted from the frame memory to a latter stage LUT.
Figure 5:
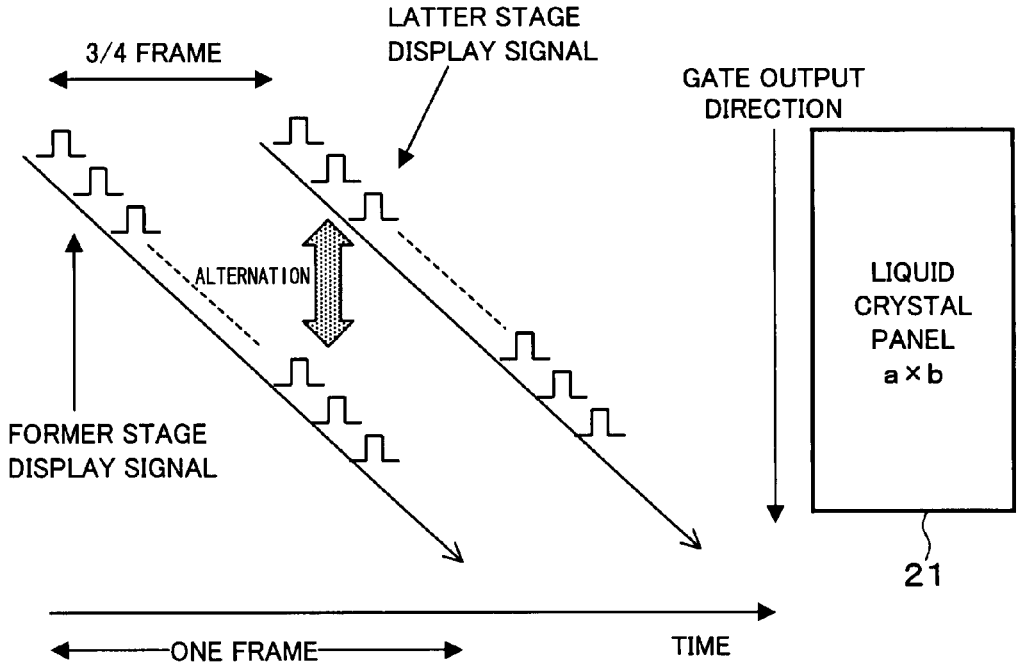
FIG. 5 illustrates an ON timing of a gate line concerning a former stage display signal and a latter stage display signal in case of dividing the frame into 3:1 in the display device of FIG. 1.

FIG. 4(*a*) illustrates an image signal inputted to the frame memory 11. FIG. 4(*b*) illustrates an image signal outputted from the frame memory 11 to the former stage LUT 12 in case of division at 3:1. FIG. 4(*c*) illustrates an image signal outputted from the frame memory 11 to the latter stage LUT 13. Further, FIG. 5 illustrates a timing at which gate lines concerning the former stage display signal and the latter stage display signal are turned ON.

As illustrated in these figures, in this case, the control section 15 applies the former stage display signal in the first frame to a pixel of each gate line at a normal clock. Further, when a ¾ frame period passes, the control section 15 starts application of the latter stage display signal. At this time, the control section 15 begins to alternately apply the former stage display signal and the latter stage display signal at a double clock.

That is, the control section 15 applies the former stage display signal to a pixel of a "¾th gate line of all the gate lines" and then stores the latter stage display signal concerning the first gate line into the source driver 23 so as to turn ON the gate line. Next, the control section 15 stores the former stage display signal concerning a "¾+1 th gate line of all the gate lines" into the source gate driver 23 so as to turn ON the gate line.

When a ¾ frame period in the first frame passes, the former stage display signal and the latter stage display signal are alternately outputted at a double clock in this manner, so that a ratio of the former sub frame and the latter sub frame can be 3:1. Further, total display luminance (integral total) in these two sub frames is integral luminance in a single frame. Note that, data stored in the frame memory 11 is outputted to the source driver 23 at a gate timing.

Figure 7:
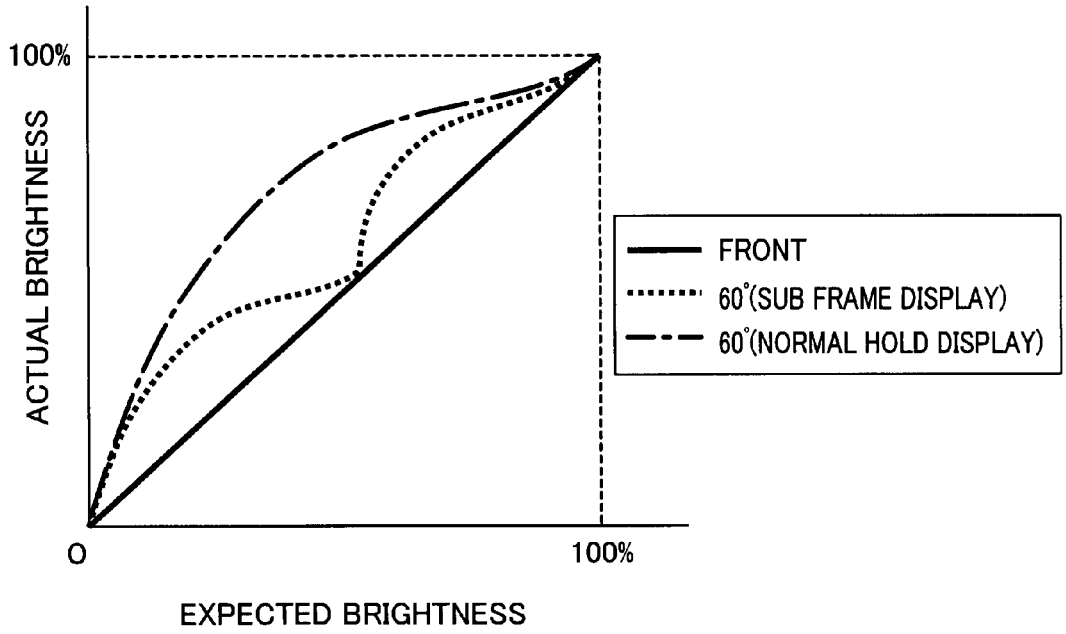
FIG. 7 is a graph illustrating a relation between expected brightness and actual brightness in case of dividing the frame into 3:1 in the display device of FIG. 1.

Further, FIG. 7 is a graph illustrating a relation between the expected brightness and the actual brightness in case of dividing a frame at 3:1. As illustrated in FIG. 7, according to the arrangement, the frame is divided in a point where deviation between the expected brightness and the actual brightness is greatest. Thus, compared with the result illustrated in FIG. 6, the difference between the expected brightness and the actual brightness in case where the viewing angle is 60° is extremely small.

That is, according to the present display device, in case of low luminance (low brightness) not more than "Tmax/4", black display is carried out in the former sub frame and display is carried out by using only the latter sub frame while preventing the integral luminance in a single frame from varying. Thus, the deviation (difference between the actual brightness and the expected brightness) in the former sub frame is minimum, so that it is possible to reduce total deviation in both the sub frames by half as indicated by the dotted line of FIG. 7.

While, in case of high luminance (high brightness), white display is carried out in the latter sub frame and display is carried out by adjusting only luminance in the former sub frame while preventing the integral luminance in a single frame from varying. Thus, also in this case, the deviation in the latter sub frame is minimum, so that it is possible to reduce total deviation in both the sub frames by half as indicated by the dotted line of FIG. 7.

In this way, according to the present display device, it is possible to entirely reduce the deviation in the brightness compared with the arrangement carrying out normal hold display. As a result, it is possible to more effectively suppress excess brightness of a halftone image as illustrated in FIG. 2.

In the foregoing description, the former stage display signal in the first frame is applied to a pixel of each gate line at a normal clock during a period from start of the display until a ¾ frame period passes. This is because this stage is not a timing at which the latter stage display signal is applied to the pixel.

However, instead of the foregoing operation, it is possible to adopt an arrangement in which a dummy latter stage display signal is used so as to carry out display at a double clock from start of the display. That is, it may be so arranged that a former stage display signal and a latter stage display signal whose signal gradation is 0 (dummy latter stage display signal) are alternately outputted during a period from start of the display until a ¾ frame period passes.

The following more generally explains the case where the ratio of the former sub frame and the latter sub frame is n:1. In this case, the control section 15 carries out gradation expression by displaying minimum luminance (black) in the former sub frame and by adjusting only display luminance in the latter sub frame (by using only the latter sub frame) in case of outputting luminance equal to or less than 1/(n+1)(threshold luminance; Tmax/(n+1)) of the maximum luminance) in a single frame (in case of low luminance). In this case, the integral luminance in a single frame is such luminance that "(minimum luminance+luminance in the latter sub frame)/(n+1))".

Further, in case of outputting luminance higher than the threshold luminance (Tmax/(n+1)) (in case of high luminance), the control section 15 carries out gradation expression by displaying maximum luminance (white) in the latter sub frame and by adjusting display luminance in the former sub frame. In this case, the integral luminance in a single frame is such luminance that "(luminance in the former sub frame+maximum luminance)/(n+1)".

Next, the following specifically explains the signal gradation setting carried out with respect to the display signals (the former stage display signal and the latter stage display signal) for obtaining the display luminance. Note that, also in this case, the signal gradation (and below-described output operation) is set so as to satisfy the aforementioned conditions (a) and (b).

First, based on the expression (1), the control section 15 calculates a frame gradation corresponding to the aforementioned threshold luminance (Tmax/(n+1)) in advance.

That is, in accordance with the expression (1), the frame gradation (threshold luminance; Lt) corresponding to the display luminance is as follows $$Lt=(1/(n+1))^{(1/\gamma)}\times L\max \quad (10).$$

In displaying an image, the control section 15 calculates the frame gradation L in accordance with the image signal outputted from the frame memory 11. In case where L is not more than Lt, the control section 15 causes the luminance gradation (F) of the former stage display signal to be minimum (0) by using the former stage LUT 12.

While, in accordance with the expression (1), the control section 15 sets the luminance gradation (R) of the latter stage display signal, by using the latter stage LUT 13, as follows $$R=(1/(n+1))^{(1/\gamma)}\times L \quad (11).$$

In case where the frame gradation L is more than Lt, the control section 15 causes the luminance gradation (R) of the latter stage display signal to be maximum (255).

While, in accordance with the expression (1), the control section 15 sets the luminance gradation F of the former sub frame as follows $$F=((L^{\gamma}-(1/(n+1))\times L\max^{\gamma})^{(1/\gamma)} \quad (12).$$

Further, as to the operation for outputting the display signals, it is so arranged that: in the operation in case where the frame is divided at 3:1, the former stage display signal and the latter stage display signal are alternately outputted at a double clock when an n/(n+1) frame period in the first frame passes.

Further, the arrangement in which the frame is evenly divided is as follows. That is, a single frame is divided into sub frame periods expressed by "1+n(=1)". Further, the former stage display signal is outputted in a single sub frame period at a clock obtained by multiplying a normal clock by "1+n (=1)" and the latter stage display signal is continuously outputted in a subsequent period of n(=1) number of sub frames.

However, according to the arrangement, when n is 2 or more, it is necessary to extremely speed up the clock, so that this increases the device cost. Thus, when n is 2 or more, it is preferable that the former stage display signal and the latter stage display signal are alternately outputted. In this case, by adjusting a timing at which the latter stage display signal is outputted, it is possible to set the ratio of the former sub frame and the latter sub frame to n:1, so that it is possible to keep a necessary clock frequency twice as high as a normal frequency.

Further, in the present embodiment, the control section 15 uses the former stage LUT 12 and the latter stage LUT 13 so as to convert the image signal into the display signal. It may be so arranged that a plurality of former stage LUTs 12 and a plurality of latter stage LUTs 13 are provided on the present display device.

[As to the Pixel Division Driving]

Figure 8:
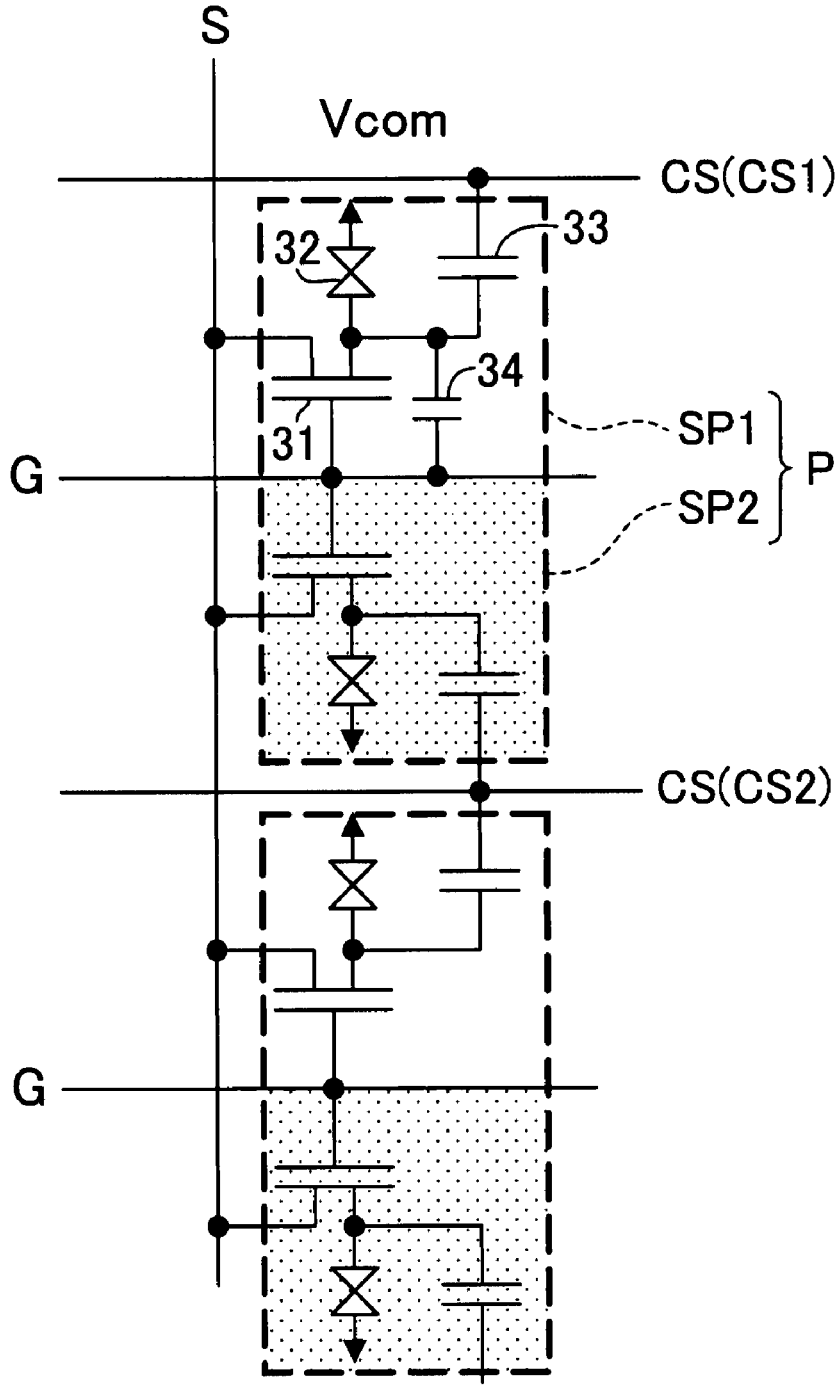
FIG. 8 is an explanatory drawing illustrating an arrangement of a liquid crystal panel driven in a pixel dividing mode.

Further, the present display device may be designed so as to carry out pixel division driving (area gradation driving). The following explains the pixel division driving of the present display device. FIG. 8 illustrates an arrangement of a liquid crystal panel 21 which is driven in a pixel dividing manner.

As illustrated in FIG. 8, the pixel division driving is carried out as follows. A single pixel P connected to a gate line G and a source line S of the liquid crystal panel 21 is divided into two sub pixels SP1 and SP2. Further, voltages applied to the sub pixels SP1 and SP2 are varied so as to carry out display. Note that, such pixel division driving is described in Japanese Unexamined Patent Publication No. 78157/2004 (Tokukai 2004-78157), Japanese Unexamined Patent Publication No. 295160/2003 (Tokukai 2003-295160), Japanese Unexamined Patent Publication No. 62146/2004 (Tokukai 2004-62146), and Japanese Unexamined Patent Publication No. 258139/2004 (Tokukai 2004-258139), for example.

The following briefly explains the pixel division driving.

As illustrated in FIG. 8, in the present display device carrying out the pixel division driving, two auxiliary capacitive wrings CS1 and CS2 different from each other are provided so as to sandwich the single pixel P. The auxiliary capacitive wirings CS1 and CS2 are connected to the sub pixel SP1 and the sub pixel SP2 respectively.

Further, in each of the sub pixels SP1 and SP2, a TFT 31, a liquid crystal capacitor 32, and an auxiliary capacitor 33 are provided.

The TFT 31 is connected to the gate line G, the source line S, and the liquid crystal capacitor 32. The auxiliary capacitor 33 is connected to the TFT 31, the liquid crystal capacitor 32, and the auxiliary capacitive wiring CS1 or CS2. An auxiliary signal which is an alternating voltage signal having a predetermined frequency is applied to each of the auxiliary capacitive wirings CS1 and CS2. Further, phases of the auxiliary signals respectively applied to the auxiliary capacitive wirings CS1 and CS2 are opposite to each other (different from each other at 180°).

The liquid crystal capacitor 32 is connected to the TFT 31, a common voltage Vcom, and the auxiliary capacitor 33. Further, the liquid crystal capacitor 32 is connected to a parasitic capacitance generated between the liquid crystal capacitor 32 and the gate line G.

In the arrangement, when the gate line G is ON, the TFTs 31 of both the sub pixels SP1 and SP2 in the single pixel P become ON.

Figure 9:
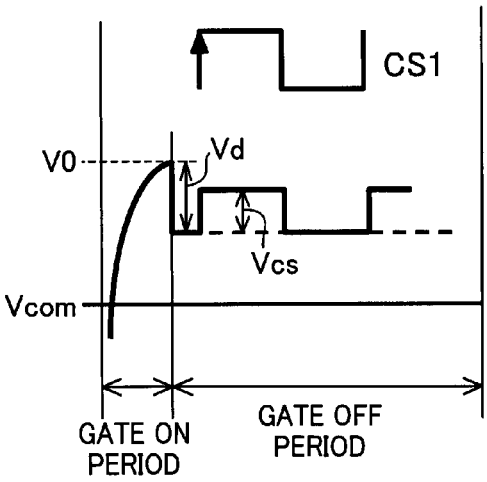
FIG. 9(*a*) is a graph illustrating a voltage (liquid crystal voltage) applied to a liquid crystal capacitor of a sub pixel in case where a positive (≧Vcom) display signal is applied to a source line S.
Figure 9:
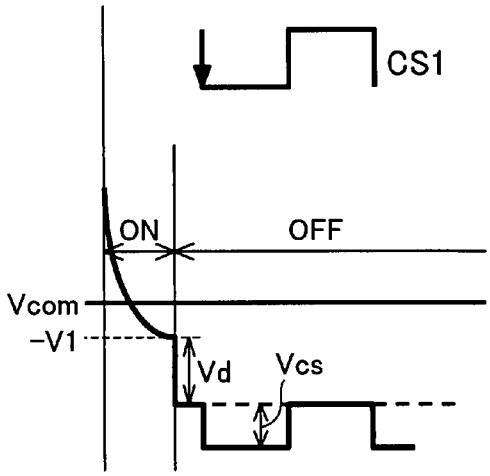
Figure 9:
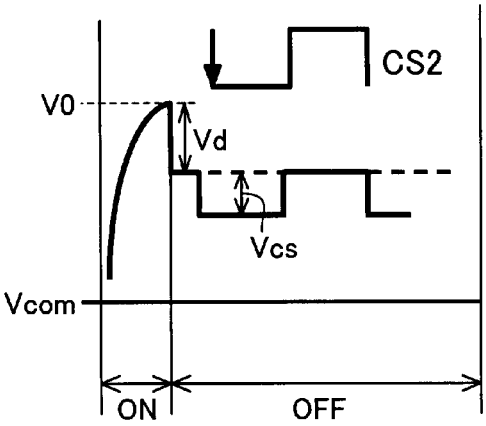
Figure 9:
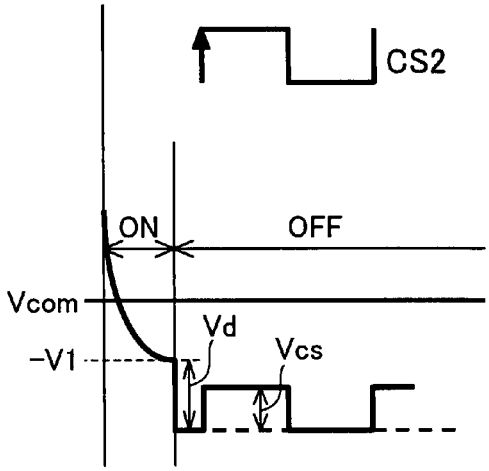

Each of FIGS. 9(*a*) and 9(*c*) is a graph illustrating a voltage (liquid crystal voltage) applied to the liquid crystal capacitors 32 of each of the sub pixels SP1 and SP2 in case where a positive (≧Vcom) display signal is applied to the source line S.

In this case, as illustrated in FIGS. 9(*a*) and 9(*c*), a voltage value of the liquid crystal capacitor 32 of each of the sub pixels SP1 and SP2 rises to a value (V0) corresponding to the display signal. Further, when the gate line G becomes OFF, a gate pull-in phenomenon caused by the parasitic capacitance 34 causes the liquid crystal voltage to drop by Vd.

At this time, in case where the auxiliary signal of the auxiliary capacitive wiring CS1 rises (in case where the auxiliary signal rises from a low level to a high level), a liquid crystal voltage of the sub pixel SP1 connected to the auxiliary capacitive wiring CS1 rises by Vss (a value corresponding to an amplitude of the auxiliary signal flowing to the auxiliary capacitive wiring CS1). Further, between V0 to V0-Vd, oscillation corresponding to the frequency of the auxiliary signal is carried out with an amplitude Vcs in accordance with a frequency of the auxiliary capacitive wiring CS.

While, in this case, the auxiliary signal of the auxiliary capacitive wiring CS2 drops (the auxiliary signal drops from a high level to a low level) as illustrated in FIG. 9(*c*). Further, a liquid crystal voltage of the sub pixel SP2 connected to the auxiliary capacitive wiring CS2 drops by the value Vcc corresponding to the amplitude of the auxiliary signal. Thereafter, oscillation is carried out between V0-Vd to V0-Vd-Vcs.

Further, each of FIGS. 9(*b*) and 9(*d*) is a graph illustrating a liquid crystal voltage of each of the sub pixels SP1 and SP2 in case where a negative (≦Vcom) display signal is applied to the source line S when the gate line G is ON. In this case, the liquid crystal voltage of each of the sub pixels SP1 and SP2 drops to a value (−V1) corresponding to the display signal as illustrated in these figures. Thereafter, when the gate line G becomes OFF, the aforementioned pull-in phenomenon causes the liquid crystal voltage to further drop by Vd.

At this time, in case where the auxiliary signal of the auxiliary capacitive wiring CS1 drops as illustrated in FIG. 9(*b*), the liquid crystal voltage of the sub pixel SP1 connected to the auxiliary capacitive wiring CS1 further drops by Vcs. Further, the liquid crystal voltage oscillates between −V0-Vd-Vcs and −V0-Vd.

While, in this case, the auxiliary signal of the auxiliary capacitive wiring CS2 rises as illustrated in FIG. 9(*d*). Further, the liquid crystal voltage of the sub pixel SP2 connected to the auxiliary capacitive wiring CS2 rises by Vcs. Thereafter, the liquid crystal voltage oscillates between V0-Vd and V0-Vd-Vcs.

In this way, by applying auxiliary signals whose phases are different from each other at 180° to the auxiliary capacitive wirings CS1 and CS2 respectively, it is possible to make the liquid crystal voltages of the sub pixels SP1 and SP2 different from each other. That is, in case where the display signal of the source line S is positive, as to a sub pixel receiving the auxiliary signal which rises right after the pull-in phenomenon, an absolute value of the liquid crystal voltage is higher than the display signal voltage (FIG. 9(*a*)).

While, as to a sub pixel receiving the auxiliary signal which drops at this time, an absolute value of the liquid crystal voltage is lower than the display signal voltage (FIG. 9(*c*)).

Further, in case where the display signal of the source line S is negative, as to a sub pixel receiving the auxiliary signal whose potential drops right after the pull-in phenomenon, an absolute value of a voltage applied to the liquid crystal capacitor 32 is higher than the display signal voltage (FIG. 9(*b*)).

While, as to a sub pixel receiving the auxiliary signal which rises at this time, an absolute value of the liquid crystal voltage is lower than the display signal voltage (FIG. 9(*d*)).

Thus, in examples illustrated in FIGS. 9(*a*) to 9(*d*), the liquid crystal voltage (absolute value) of the sub pixel SP1 is higher than that of the sub pixel SP2 (the display luminance of the sub pixel SP1 is higher than that of the sub pixel SP2). Further, the difference (Vcs) between the liquid crystal voltages of the sub pixels SP1 and SP2 can be controlled in accordance with amplitude values of the auxiliary signals applied to the auxiliary capacitive wirings CS1 and CS2. As a result, it is possible to give a desired difference between display luminance (first luminance) of the sub pixel SP1 and display luminance (second luminance) of the sub pixel SP2.

Table 1 shows (i) polarities of the liquid crystal voltages respectively applied to a sub pixel whose luminance is high (bright pixel) and a sub pixel whose luminance is low (dark pixel) and (ii) states of the auxiliary signals right after the pull-in phenomenon. Note that, the polarities of the liquid crystal voltages are indicated by "+, −" in Table 1. Further, "↑" indicates a case where the auxiliary signal rises right after the pull-in phenomenon and "↓" indicates a case where the auxiliary signal drops.

TABLE 1

| | | |
|---|---|---|
| Bright pixel | +, ↑ | −, ↓ |
| Dark pixel | +, ↓ | −, ↑ |

Note that, in the pixel division driving, the luminance of the pixel P is equal to a total of the luminance of the sub pixel SP1 and the luminance of the sub pixel SP2 (the total luminance corresponds to transmittance of the liquid crystal).

Figure 10:
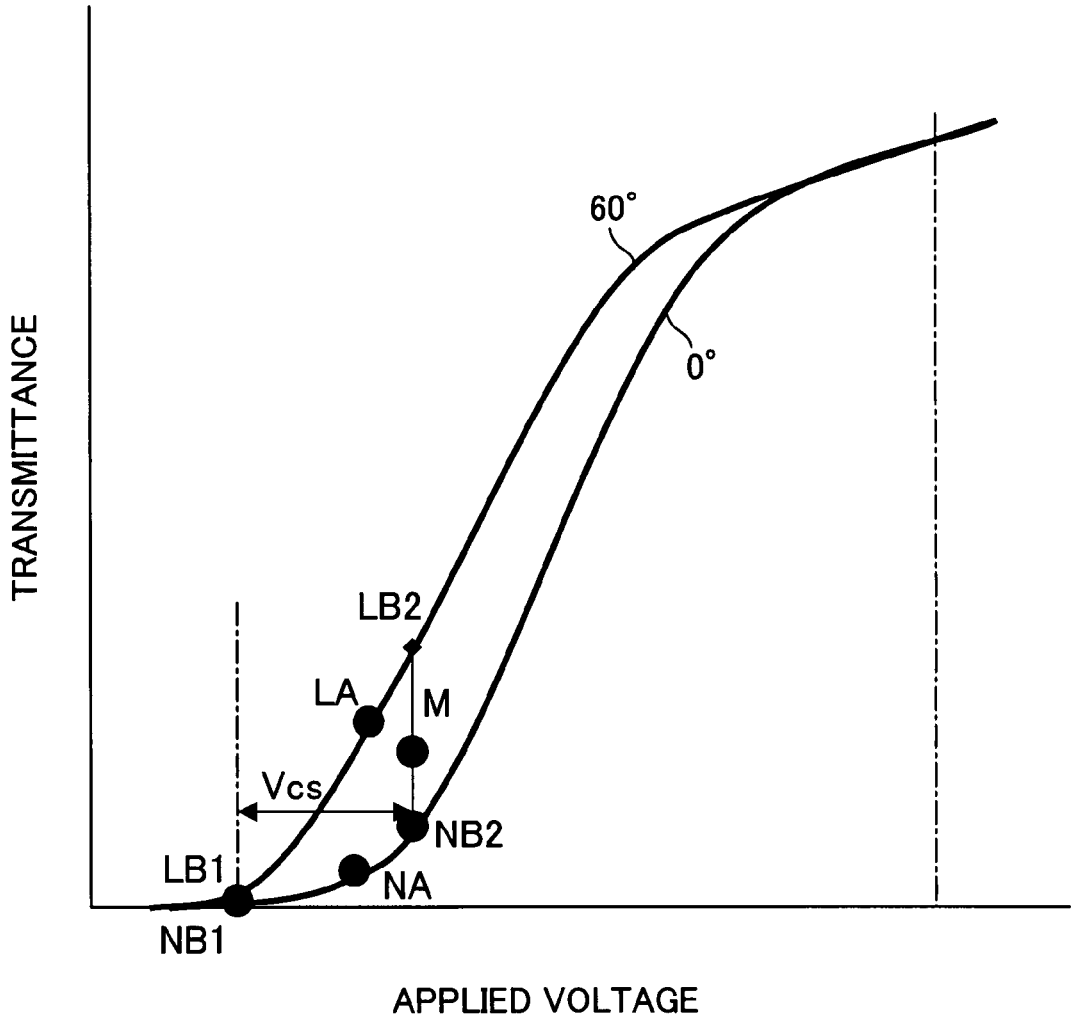
FIG. 10 is a graph illustrating a relation between a transmittance and an applied voltage of a liquid crystal panel 21 at two viewing angles (0° (front) and 60°) in case where pixel division driving is not carried out.

FIG. 10 is a graph illustrating a relation between the transmittance of the liquid crystal panel 21 and the applied voltage at two viewing angles (0° (front) and 60°) in case where the pixel division driving is not carried out. As illustrated in the graph, in case where the transmittance in the front direction is NA (in case where the liquid crystal voltage is controlled so that the transmittance is NA), the transmittance is LA at a viewing angle of 60°.

In order that the transmittance in the front direction in the pixel division driving is NA, voltages which are different from each other by Vcs are respectively applied to the two sub pixels SP1 and SP2 and transmittances thereof are set to NB1 and NB2 (NA=(NB1+NB2)/2).

Further, in case where the transmittances of the sub pixels SP1 and SP2 at 0° are respectively NB1 and NB2, the transmittances at 60° are respectively LB1 and LB2. Further, LB1 is substantially 0. Thus, a transmittance of a single pixel is M (LB2/2), so that the transmittance is lower than LA. In this way, by carrying out the pixel division driving, it is possible to improve the viewing angle property.

Further, if the pixel division driving is adopted for example, it is possible to display an image whose luminance is low (high) by setting luminance of one sub pixel to be black display (white display) and adjusting luminance of the other sub pixel through increase of an amplitude of the CS signal. As a result, as in the sub frame display, it is possible to minimize the deviation between the display luminance and the actual luminance in the other sub pixel, thereby further improving the viewing angle property.

Further, the arrangement may be such that black display (white display) is not carried out in the other sub pixel. That is, if a luminance difference occurs between both the sub pixels, it is possible to improve the viewing angle in theory. Thus, it is possible to make the CS amplitude smaller, so that it is easy to design the pulse driving. Further, as to all the display signals, it is not necessary to differentiate the luminance of the sub pixel SP1 and the luminance of the sub pixel SP2 from each other. For example, it is preferable to equalize the luminance of the sub pixel SP1 and the luminance of the sub pixel SP2 in carrying out the white display or the black display. Thus, the arrangement may be made in any manner as long as the sub pixel SP1 has first luminance and the sub pixel SP2 has second luminance which is different from the first luminance with respect to at least one display signal (display signal voltage).

Further, as to the aforementioned pixel division driving, it is preferable to change the polarity of the display signal applied to the source line S for each frame. That is, in case of driving the sub pixels SP1 and SP2 in a certain frame as illustrated in FIG. 9(*a*) or FIG. 9(*c*), it is preferable to drive the sub pixels SP1 and SP2 in a subsequent frame as illustrated in FIG. 9(*b*) or FIG. 9(*d*). As a result, a total voltage applied to the two liquid crystal capacitors 32 of the pixel P in two frames can be set to 0V. Thus, it is possible to cancel a direct current component of the applied voltage.

Note that, in the aforementioned pixel division driving, a single pixel is divided into two sub pixels. However, the present invention is not limited to this, and a single pixel may be divided into three sub pixels.

The aforementioned pixel division driving may be combined with normal hold display or may be combined with sub frame display. Further, the pixel division driving may be combined with polarity inversion driving.

Figure 11:
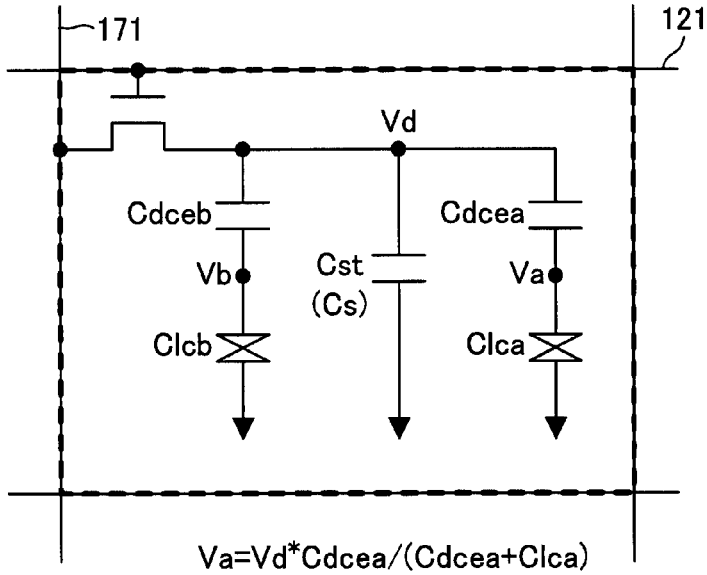
FIG. 11 illustrates another arrangement of the liquid crystal panel driven with its pixel divided.

Further, the display device of the present embodiment may be arranged so that a pixel is divided on the basis of a circuit arrangement illustrated in FIG. 11. Voltages Va and Vb of electrodes of pixels obtained by dividing the pixel are as follows $$Va=Vd\times Cdcea/(Cdcea+Clca)$$

$$Vb=Vd\times Cdecb/(Cdecb+Clcb).$$

In this way, if a single pixel region is divided into two sub pixels and an electric field is generated so that both the regions are slightly different from each other, influences of both the regions are compensated for each other, thereby improving lateral visibility. At this time, the voltage Va of one of the two regions (pixel electrodes) is set to be higher than the voltage Vb of the other pixel electrode, so that a potential difference occurs in the sub pixels, thereby obtaining the same effect as that of the area division pixel driving.

As to adjustment of the voltages Va and Vb, Cdcea, Cdceb, and Clcb are determined in designing the liquid crystal display device. Further, the liquid crystal display device illustrated in FIG. 11 may be arranged so that: for example, Cdceb is removed and a drain electrode and Clcb are directly connected to each other and Cdcea and Clca are adjusted so as to generate a potential difference between Vb(Vd) and Va.

[Adjustment of Luminance Gradations of the First and Second Display Signals]

As to the aforementioned liquid crystal display device based on the pixel division driving, the following explains how color deviation is suppressed by adjusting the first and second display signals.

As described above, the liquid crystal display device adopting the conventional area division pixel driving method raises a problem such as color deviation caused by inflection of the viewing angle property. Further, in the liquid crystal display device whose pixel has the first sub pixel and the second sub pixel, the first and second display signals serving as display signals of the first and second sub frames respectively are generated so that division of the frame does not change total luminance outputted from the display section in a single frame and the generated first and second display signals are outputted to the display section (this arrangement is hereinafter referred to as "frame division pixel driving"), thereby suppressing the excess brightness and the color deviation.

However, mere adoption of the frame division pixel driving to the liquid crystal display device whose pixel is based on the area division pixel driving method results in color deviation caused by the inflection of the viewing angle property. The following explains why the color deviation occurs.

Figure 12:
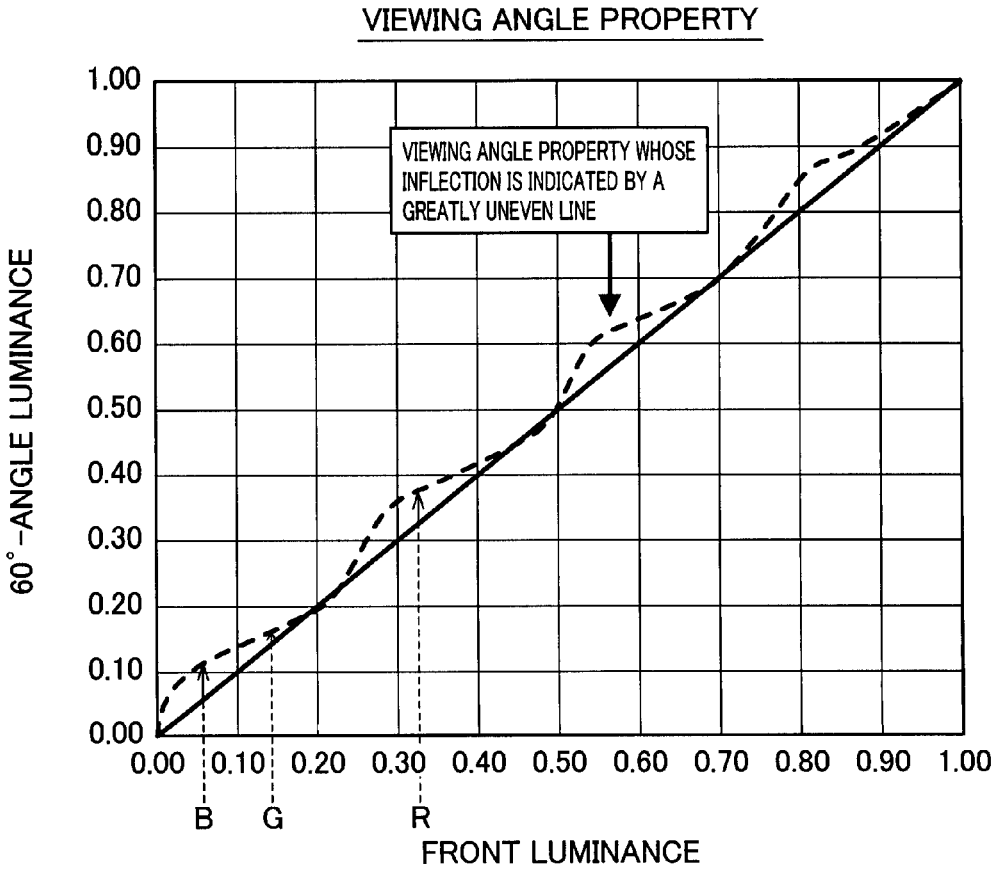
FIG. 12 is a graph illustrating a viewing angle property of a display device in which a pixel based on an area division pixel driving mode adopts a frame division pixel driving mode.

FIG. 12 is a graph illustrating the viewing angle property of the liquid crystal display device, using the frame division pixel driving, whose pixel is based on the area division pixel driving method. As an example, the following explains a flesh color constituted of three colors as R (red), G (green), and B (blue) so that (R, G, B)=(160, 120, 80) gradation. The luminance is equal to the 2.2nd power of the gradation, so that R, G, and B are respectively in positions indicated in FIG. 12.

In obliquely viewing the flesh color at 60°, luminance of each of R, G, and B increases in accordance with the viewing angle property of the liquid crystal display device. As illustrated in FIG. 12, the luminance of G viewed from the front direction and the luminance of G obliquely view at 60° are hardly different from each other, but the luminance of R and the luminance of B which are obliquely viewed at 60° are higher than those viewed from the front direction. Thus, a luminance ratio of R, G, and B constituting the flesh color deviates from a luminance ratio viewed from the front direction, so that the flesh color obliquely viewed deviates from the flesh color viewed from the front direction. The color deviation is greater as a curvature in the inflection point of the viewing angle property is greater.

Thus, in order to improve the color deviation in case of adopting the frame division pixel driving to the liquid crystal display device whose pixel is based on the area pixel driving method, it is effective to decrease the curvature in the viewing angle property (see a dotted line of FIG. 12) indicative of a relation between the front luminance and the obliquely viewed luminance at 60°.

By adjusting the luminance gradations of the first and second display signals in accordance with the following method, it is possible to suppress the color deviation of the liquid crystal display device.

1 A viewing angle with respect to the display section (display panel) is measured.

2 The front luminance and the obliquely viewed luminance which have been measured are standardized in terms of maximum luminance and minimum luminance. For example, the obliquely viewed luminance at horizontally 60° and vertically 0° is used.

3 As to the display section, its viewing angle property in a front direction and in an oblique direction is converted into brightness. In calculation of the brightness, an approximate expression of the ½.5th power of the luminance is used. By carrying out the brightness conversion, it is possible to correlate the luminance with actual appearance. An example thereof is as follows: the human eye is sensitive to certain luminance increase when the luminance is low but is not sensitive to luminance difference when the luminance is high.

Note that, the brightness (L*) is strictly as follows $$L^*=116(Y)\hat{}(1/3)-16(Y/Y0>0.00885)$$

(Y: standardized luminance).

It is generally known that this expression can be approximated by L=Y^(½.5).

4 A graph illustrating the viewing angle property of the display section is made so as to have a horizontal axis [front standardized brightness (front brightness)] and a vertical axis [oblique standardized brightness (oblique brightness)]. A curved thick continuous line of the graph in FIG. 13 indicates the viewing angle property (A(x)).

5 An approximate curve (x^(n/2.2)) which is approximate to the curve indicative of the viewing angle property is calculated.

Herein, the approximate curve is a function of x^(n/2.2). n is defined as an approximate gamma coefficient. The function has a more linear line in the graph as n approximates to 2.2. Further, n=2.2 means that the relation between the gradation and the luminance is indicated by the 2.2nd power and they are in an ideal relation.

6 The approximate gamma coefficient n is calculated.

Such an n value that an integral value of a difference (indicated by a shaded portion of FIG. 13) between the viewing angle property and the approximate curve is minimum is picked out. At this time, if the curve A(x) indicative of the viewing angle property is positioned below the approximate curve indicated as $X^{n/2.2}$, integration is carried out as minus. If the curve A(x) is positioned above the approximate curve, integration is carried out as plus.

The approximate curve using the n value at this time corresponds to a curve most approximate to the viewing angle property.

7 The deviation M is calculated.

An integral value of an absolute value of the difference between the oblique brightness of the viewing angle property and the oblique brightness of the approximate curve is defined as the deviation M.

A specific expression is as follows.

$$\text{Deviation } M=\int|A(x)-x\hat{}(n/2.2)|dx$$

Herein, when the deviation M is 0, this means that there is no deviation from the approximate curve.

[As to Measurement Condition of the Viewing Angle Property]

Figure 14:
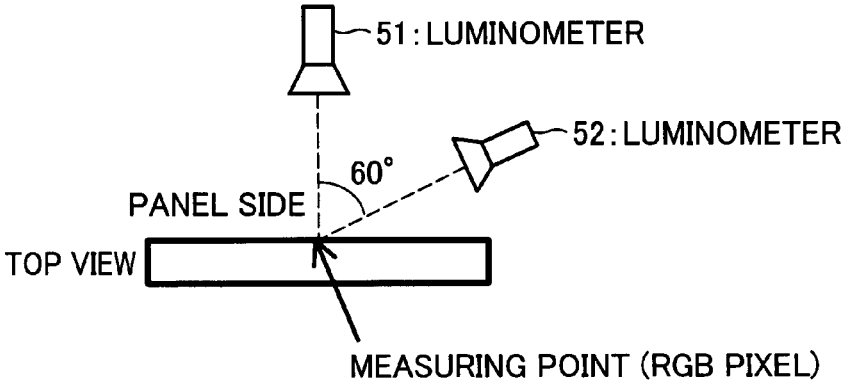
FIG. 14(*a*) is a diagram schematically illustrating a positional relation between the display section and a luminometer in measuring a viewing angle property, and illustrates the positional relation viewed from an upper direction with respect to the display section.
Figure 14:
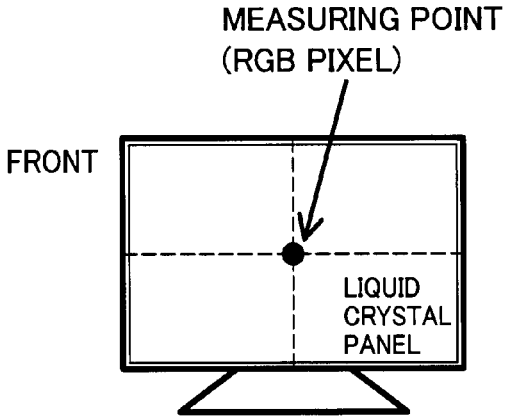
Figure 14:
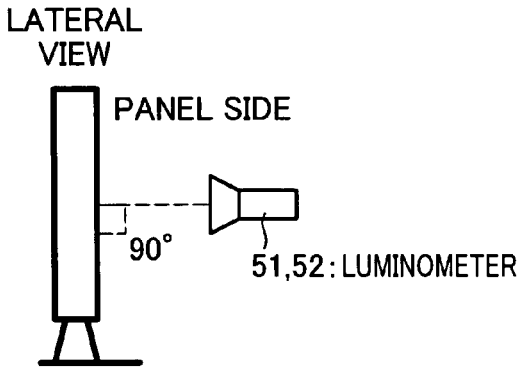

In order to suppress the color deviation in the liquid crystal display device, it is necessary to measure the viewing angle in the display section of the liquid crystal display device. The following explains a measurement condition in measuring the viewing angle property of the display section (liquid crystal panel). Each of FIGS. 14(*a*), 14(*b*), and 14(*c*) schematically illustrates a positional relation between luminance measuring devices 51 and 52 and the display section. FIG. 14(*a*) is a top view of the display section in measuring the viewing angle property. FIG. 14(*b*) is a front view of the display section. FIG. 14(*c*) is a lateral view of the display section.

As illustrated in FIG. 14(*b*), in order to avoid any influence such as a black mask in each pixel, it is necessary to prepare an area of about 50 to 100 pixels as a measurement point in the display section of the liquid crystal display device. Note that, in FIG. 14(*b*), illustration of the measuring devices 51 and 52 are omitted so as to indicate the measurement point in the display section. Further, as illustrated in FIG. 14(*a*), the measuring device 51 is positioned in front of the display panel face of the display section, and the measuring device 52 is positioned obliquely at an angle of 60° with respect to the front. Further, as illustrated in FIG. 14(*c*), the measuring devices 51 and 52 are disposed so that measuring directions thereof are orthogonal to a vertical direction of the display panel.

An input signal used in the measurement is a signal which allows luminance ranging from minimum to maximum of the display panel to be displayed in the measurement point of the display panel at the time of the measurement carried out by the measuring device 51. Particularly, a recent TV set has such a function that intensity of backlight is adjusted depending on the input signal or such a function that its gamma property is changed depending on the input signal, so that it is necessary to prevent these functions from influencing the measurement results by canceling these functions.

The measurement is carried out with respect to luminance ranging from the minimum to the maximum. A measurement interval is 0 gradation in the minimum luminance. In case where the maximum luminance is 255 gradation, the measurement interval is 16 gradation.

At this time, on the assumption that the gradation is N, the measurement luminance is set so as to satisfy the following expression.

$$\text{Measurement luminance}(N)=[\text{maximum luminance}-\text{minimum luminance}]\times(N/255)\hat{}(2.2)+[\text{minimum luminance}]$$

Further, the luminance measurement for each gradation is carried out as follows. The measuring devices 51 and 52 are used so as to simultaneously measure the front luminance and the oblique luminance, and the measurement is carried out for a time period equal to integral multiple of a single frame or for one or more seconds unless it is the integral multiple.

A distance (measurement distance) from the measurement, point in the display face of the display section may be arbitrarily set as long as it is possible to sufficiently measure the luminance of the measurement point. It is not necessary that the distance from the measuring device 51 and the distance from the measuring device 52 are equal to each other, but it is preferable not to position one of the devices extremely further from the measurement point than the other one. Further, a surrounding of the measurement is a dark room and a measurement temperature is a room temperature (25° C.).

[As to the Approximate Gamma Coefficient and the Color Deviation]

(1 As to the Approximate Gamma Coefficient (n))

Figure 13:
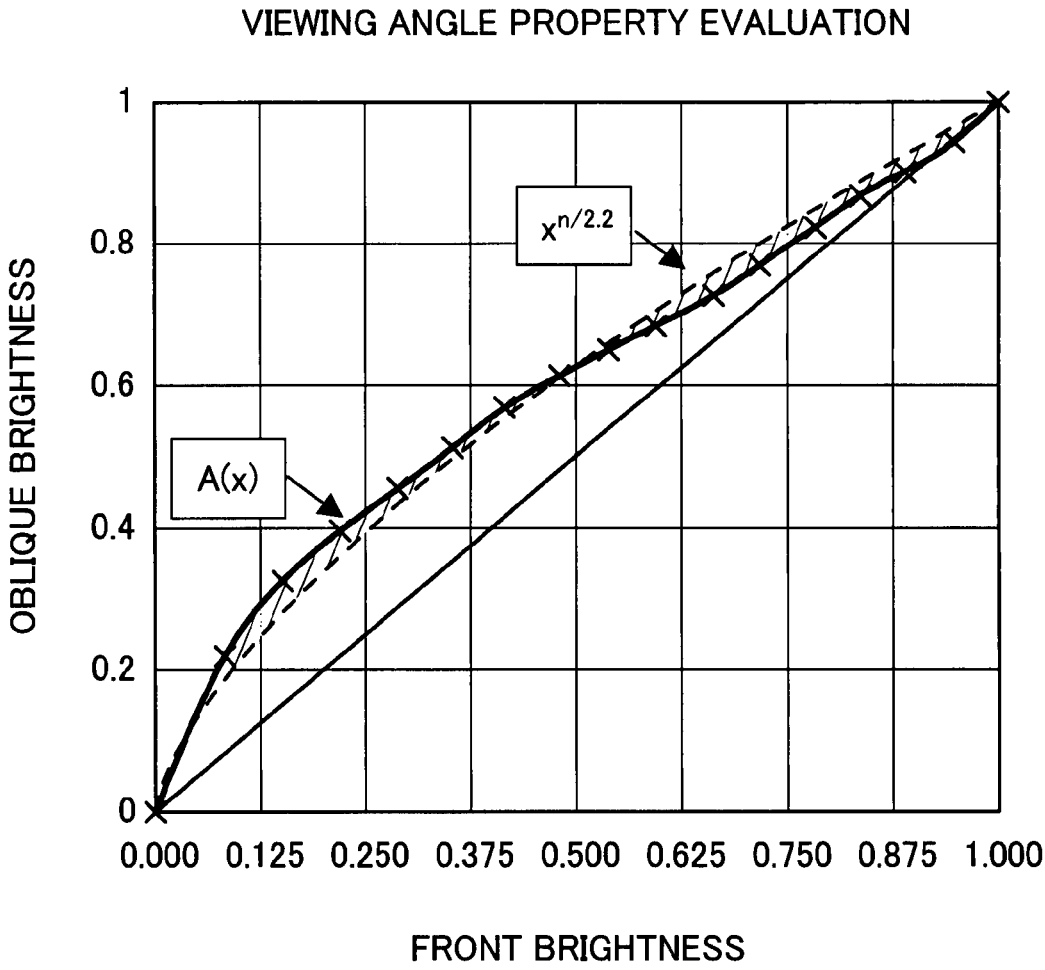
FIG. 13 is a graph illustrating a viewing angle property of a display section of the display device.

The function ($X^{n/2.2}$) of the approximate curve indicative of the viewing angle property illustrated in FIG. 13 has a gentle curve as a whole. If the display section has the viewing angle property indicated by such a curve, the display section is free from any problem concerning the color deviation. That is, as described above, the color deviation is caused by the curve indicative of the viewing angle property, so that it is possible to suppress the color deviation by approximating the viewing angle property of the display section to the aforementioned function.

Further, as the gamma coefficient of the approximate curve is further below 2.2, the display section is more excessively bright. Thus, the gamma coefficient "n" of the approximate curve can be used to determined whether the entire display state is excessively bright or not.

(2 As to the Deviation (D Value))

In the liquid crystal display device of the present embodiment, the deviation from the approximate curve indicative of the viewing angle property that was explained with reference to FIG. 13 is used to determine how gentle the curve indicative of the viewing angle property of the obliquely viewed display section is. When the deviation is decreased, inflection in the curve indicative of the actual viewing angle property of the display section decreases, so that it is possible to provide the display section having less strange feeling caused by the color deviation in being viewed from the oblique direction.

It is preferable that the integral value of the difference from the approximate curve approximate to the viewing angle property is set to 0 by adjusting the first and second display signals respectively serving as the first and second sub frame display signals. However, if the D value is not more than 0.0202, there is no problem concerning the color deviation in actually using the display section. Note that, the D value not more than 0.0202 has not been achieved by any existing product which carries out the pixel division gradation driving.

Further, the liquid crystal display device of the present embodiment has a control section adopting both the area division pixel driving and the frame division pixel driving, so that it is possible to realize the D value which cannot be achieved only by the area division pixel driving. Specifically, it is possible to realize the display section having such a viewing angle property that its D value is not more than 0.0202.

In this way, in the liquid crystal display device according to the present embodiment, it is possible to realize the display section having such a viewing angle property that its D value is not more than 0.0202. Taking advantage of this arrangement, subjective evaluation was carried out with respect to the value range, which had been hard for a conventional display device to achieve, so as to find out a more favorable viewing angle property, thereby finding out the relation between the D value and the n value indicative of the approximate gamma coefficient.

In the subjective evaluation, evaluation was carried out with the D value ranging from 0 to 0.025 and the n value ranging from 1.2 to 2.2, and a trial subject subjectively evaluated test images, whose D values and n values were different from each other, on the basis of the following one-to-five scale evaluation. Specifically, as to the test images, the trial subject compared an image viewed from a front direction (an original image) with an image viewed from an oblique direction (a processed image obtained by converting its viewing angle property into a gradation so that the image actually appeared to be the same as an obliquely viewed image), so as to evaluate the test images with numerical points in view of the color deviation and the excess brightness. That is, the trial subject gave each test image a numerical value in accordance with the following standard, and used also an intermediate value such as 4.5.

5: Substantially the same (as the original image)

4: Little bit different (from the original image) but seems not strange

3: Different (from the original image) but seems not strange

Figure 30:
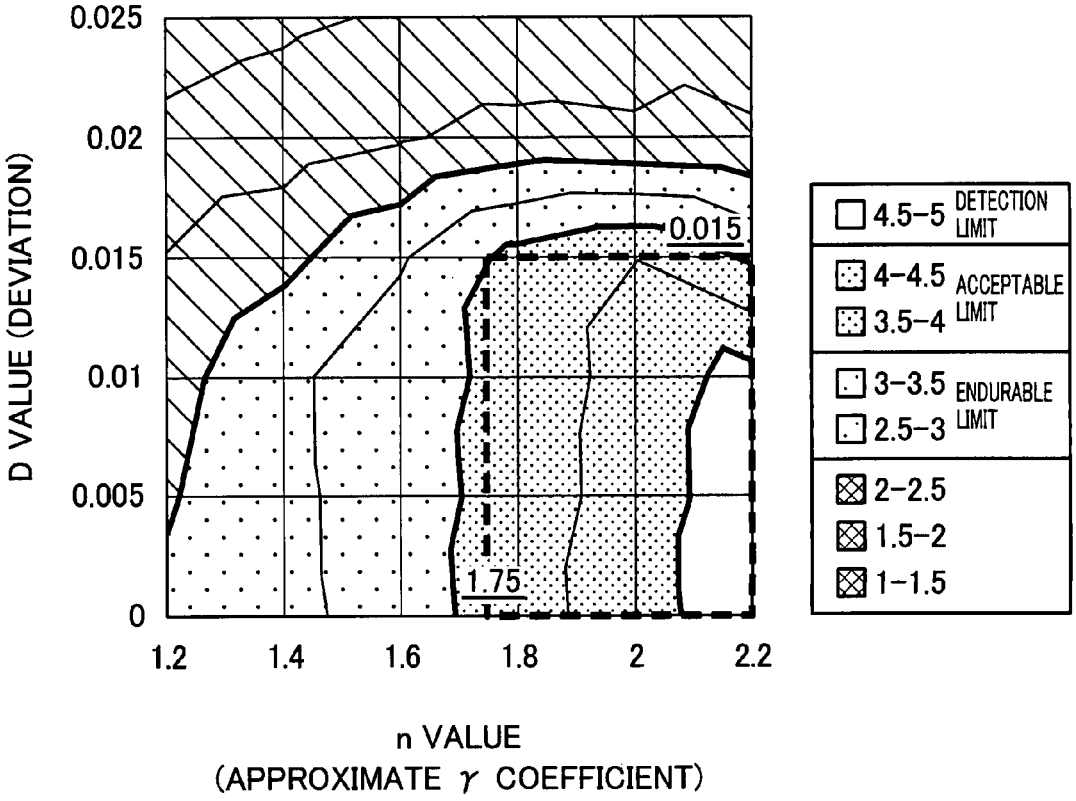
FIG. 30 is a graph illustrating results of subjective evaluation on a viewing angle property of the liquid crystal display device according to the present embodiment.

2: So different (from the original image) that the trial subject feels uncomfortable 1: So different (from the original image) that the trial subject feels extremely uncomfortable FIG. 30 shows results of the subjective evaluation. In FIG. 30, a horizontal axis indicates the approximate gamma coefficient (n value) and a vertical axis indicates the deviation (D value), and the numeral values of the test images are divided into areas as parameters. In FIG. 30, a range in which the numeral value is from 4.5 to 5 is a detection limit, a range in which the numeral value is from 3.5 to 4.5 is an acceptability limit, and a range in which the numeral value is from 2.5 to 3.5 is an endurable limit.

Herein, the detection limit is an area in which the obliquely viewed image seems not deteriorate compared with the front image. The acceptability limit is an area in which the deterioration is found but seems not strange. Further, the endurable limit is an area in which the deterioration seems great trouble.

In FIG. 30, the area including the detection limit and the acceptability limit is such that the D value substantially corresponds to a range not more than 0.015 and the n value substantially corresponds to a range not less than 1.75. In more specific evaluation, if the D value is not more than 0.015, it is possible to suppress the color deviation to the acceptability limit. Further, if the n value is not less than 1.75, it is possible to suppress the excess brightness to the acceptability limit. Thus, in the liquid crystal display device according to the present embodiment, if the D value is adjusted to not more than 0.015 and the n value is adjusted to not less than 1.75, it is possible to reduce the color deviation and the excess brightness in the display section compared with the conventional arrangement.

[Adjustment of the Deviation (D Value)]

The deviation (D value) in the display section of the display device can be adjusted by changing an area ratio of the sub pixels (the first sub pixel and the second sub pixel). Also, in the present invention, the frame division pixel driving is adopted together, so that it is possible to adjust the deviation by using a parameter in the below-described area gradation driving. Specifically, a time division ratio in the frame division pixel driving is carried out.

By changing the time division ratio, it is possible to adjust the deviation in the display section. This gives the same effect as that in case of changing the pixel division ratio. Thus, by independently adjusting the pixel division ratio and the time division ratio, it is possible to achieve smaller deviation.

Figure 15:
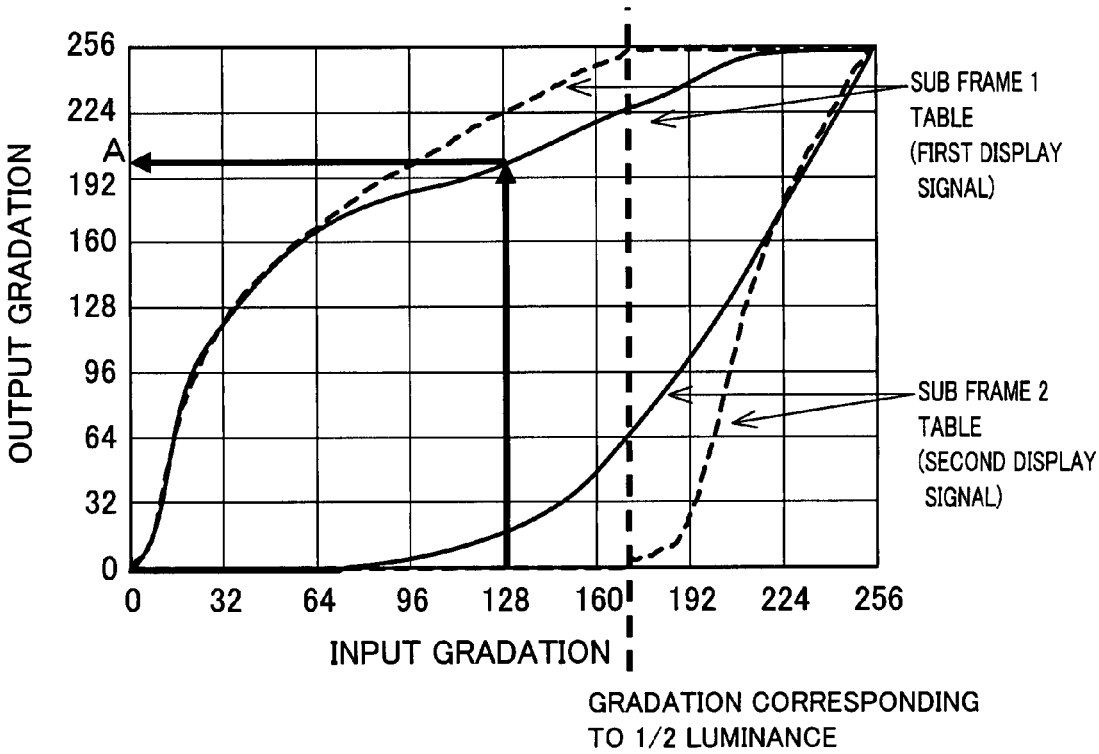
FIG. 15 is a graph illustrating adjustment of LUT in the frame division pixel driving mode.

Further, it may be possible to adjust the deviation by adjusting the LUT (look-up table). A specific example thereof is an LUT illustrated in FIG. 15. With a horizontal axis indicating an input gradation and a vertical direction indicating gradation data outputted from the table, FIG. 15 illustrates a case where a frame is divided into two sub frames (a sub frame 1 and a sub frame 2). For example, when an input of 128 gradation is received, an A gradation is outputted from an LUT for the sub frame 1 and a gradation outputted from an LUT for the sub frame 2 remains 0.

In this way, in the frame division pixel driving adopted in the liquid crystal display device of the present embodiment, it is general that a gradation inputted in the sub frame 2 remains 0 until 255 gradation is outputted in the sub frame 1. In a gradation corresponding to ½ of the luminance, 255 gradation is outputted in the sub frame 1 and 0 gradation is outputted in the sub frame 2, so that the gradation has least excess brightness in the viewing angle property. On the contrary, the gradation corresponding to ½ of the luminance corresponds to the inflection point of the viewing angle property. That is, the inflection is reduced by adjusting a table around the gradation, so that it is possible to make the deviation smaller.

Figure 16:
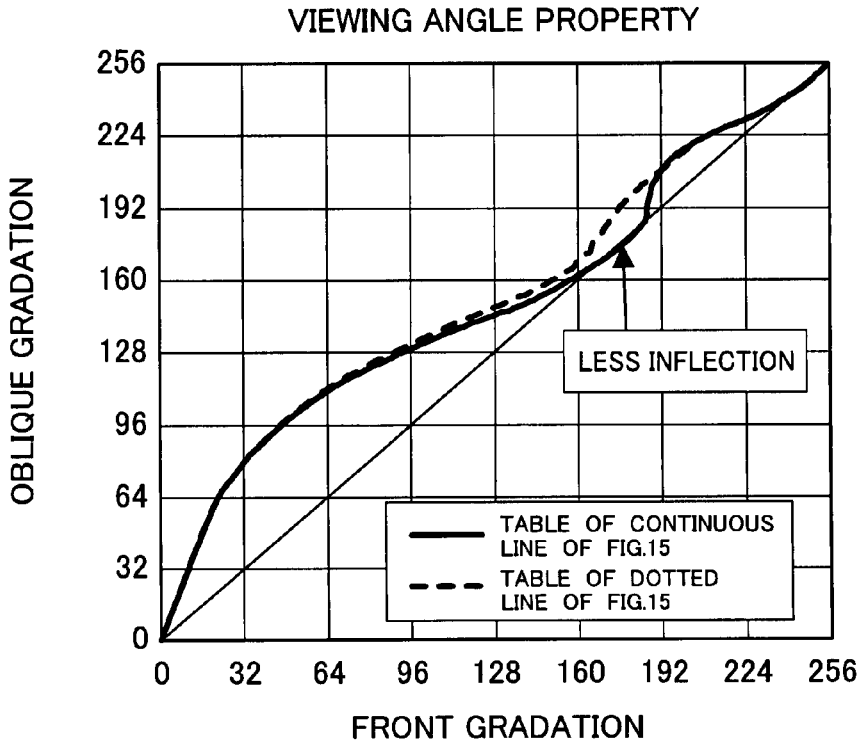
FIG. 16 is a graph illustrating how the viewing angle is varied by adjustment of the LUT in the frame division pixel driving mode as illustrated in a dotted line of FIG. 15.

For example, as illustrated by a dotted line of FIG. 15, there is used such a table that the output in the sub frame 2 is greater than 0 gradation before 255 gradation is outputted in the sub frame 1, thereby making the deviation smaller. Such table adjustment causes 255 gradation and 0 gradation not to be simultaneously outputted in the sub frame 1 and the sub frame 2, so that it is possible to make the inflection smaller as illustrated in FIG. 16.

Further, the aforementioned liquid crystal display device can serve also as an image display monitor such as a liquid crystal monitor and can serve also as a television receiver.

In case of using the liquid crystal display device as the liquid crystal display monitor, this can be realized by providing a signal input section (e.g., an input port) which inputs an image signal received from the outside to the control LSI. While, in case of using the image display device as the television receiver, this can be realized by providing a tuner section onto the image display device. The tuner section selects a channel for a television broadcasting signal and inputs a television image signal of the selected channel to the control LSI as an input image signal.

Further, in the foregoing description, all the processes in the present display device are carried out under the control of the control section 15 (see FIG. 1). However, the present invention is not limited to this arrangement. Instead of the control section, it is possible to use an information processing device which allows a program for carrying out the processes to be stored in a storage medium and allows the program to be read out.

According to the arrangement, a calculation device (CPU or MPU) of the information processing device reads out the program stored in the storage medium and carries out the processes. Thus, it can be said that the program itself realizes the processes.

Herein, not only a general computer (a workstation or a personal computer) but also a function expansion board or a function expansion unit provided on the computer can be used as the information processing device.

Further, the program is a program code (an execute form program, intermediate code program, or source program) which is software for implementing the aforementioned processes. The program may be independently used or a combination of the program and other program (OS or the like) may be used. Further, it may be so arranged that the program is read out from the storage medium and then is temporarily stored in a memory (RAM or the like) in the device and is read out again so as to be implemented.

Further, the storage medium in which the program is stored may be easily detachable from the information processing device or may be fixed (installed) on the device. Further, the storage medium may be connected to the device as an external storage device.

Examples of the storage medium which satisfies these conditions include: tapes, such as magnetic tape and cassette tape; disks including magnetic disks, such as floppy disks (registered trademark) and hard disk, and optical disks, such as CD-ROMs, magnetic optical disks (MOs), mini disks (MDs), digital video disks (DVDs), and CD-Rs; cards, such as IC card (including memory cards) and optical cards; and semiconductor memories, such as mask ROMs, EPROMs, EEPROMs, and flash ROMs.

Further, a storage medium connected to the information processing device via a communication network (Internet, intranet, and the like) may be used. In this case, the information processing device downloads the program via the network so as to obtain the program. That is, the program may be obtained via a transmission medium (medium which holds the program in a floating manner) such as a network (connected to a wired or wireless line) and the like. Note that, it is preferable that a program for downloading is stored in the device (or in a sending side device/a receiving side device) in advance.

The present invention is not limited to the description of the embodiments above, but may be altered by a skilled person within the scope of the claims. An embodiment based on a proper combination of technical means disclosed in different embodiments is encompassed in the technical scope of the present invention.

EXAMPLES

The following explains Examples and Comparative Examples, but the present invention is not limited to them.

Comparative Example 1

Figure 17:
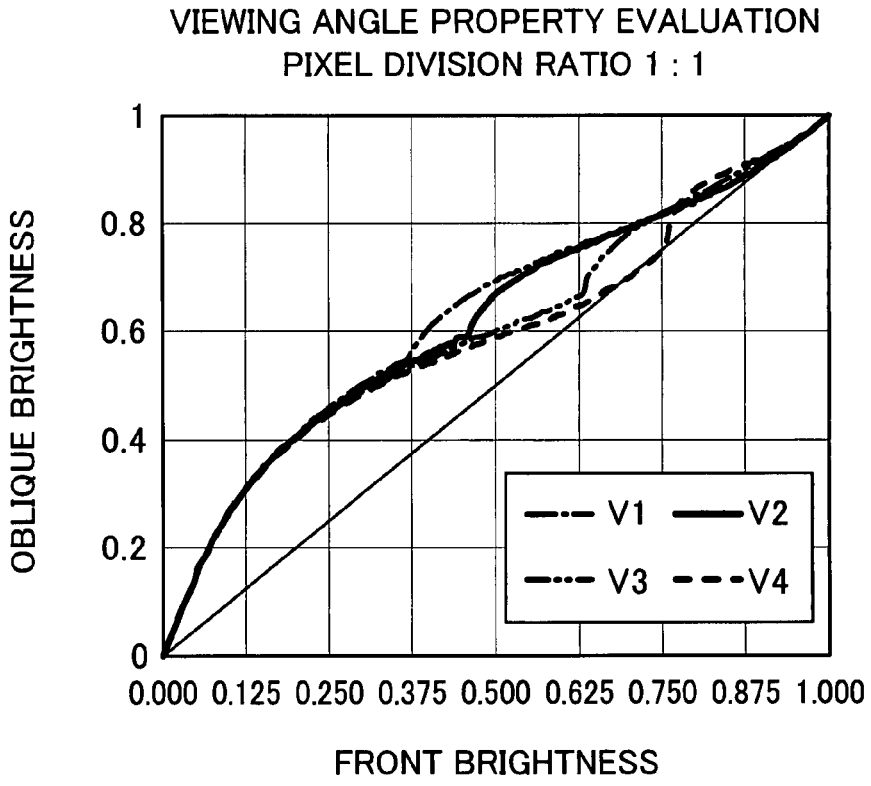
FIG. 17 is a graph illustrating an example of a viewing angle property of a liquid crystal panel which is Comparative Example 1 of the present invention and in which an area division ratio of each pixel is 1:1.

FIG. 17 is a graph illustrating an example of a viewing angle property of a liquid crystal panel whose area division ratio for each pixel is 1:1. Each of V1 to V4 in FIG. 17 indicates a result of each condition under which a combination of first luminance of the first sub pixel and second luminance of the second sub pixel was changed (the same operations were carried out in the following Comparative Examples). As illustrated in FIG. 17, a most linear line is V4. Thus, in view of the excess brightness, it is possible to improve the viewing angle property in case of V4. However, in actual appearance, a curve indicative of the viewing angle property under a condition of V4 has great inflection, so that this results in color deviation.

Thus, a luminance ratio of the first sub pixel and the second sub pixel is adjusted (a CS voltage is adjusted, thereby adjusting the viewing angle property of the liquid crystal panel. The deviation (D value) of each of V1 to V4 which has been adjusted in this manner is shown in Table 2.

TABLE 2

| 1:1 | D |
|---|---|
| V1 | 0.0223 |
| V2 | 0.0202 |
| V3 | 0.0291 |
| V4 | 0.0405 |

As shown in Table 2, the deviation (D value) is a minimum (D=0.0202) under a condition of V2. In FIG. 17, V2 has less inflection than V1 only in view of the viewing angle property, so that V1 seems to have less deviation. However, it is actual that V2 has smaller deviation (D value) than V1. This is apparent from comparison between a graph illustrating a viewing angle property of V1 indicated by FIG. 18 and its approximate curve together and a graph illustrating a viewing angle property of V1 indicated by FIG. 19 and its approximate curve together.

Figure 18:
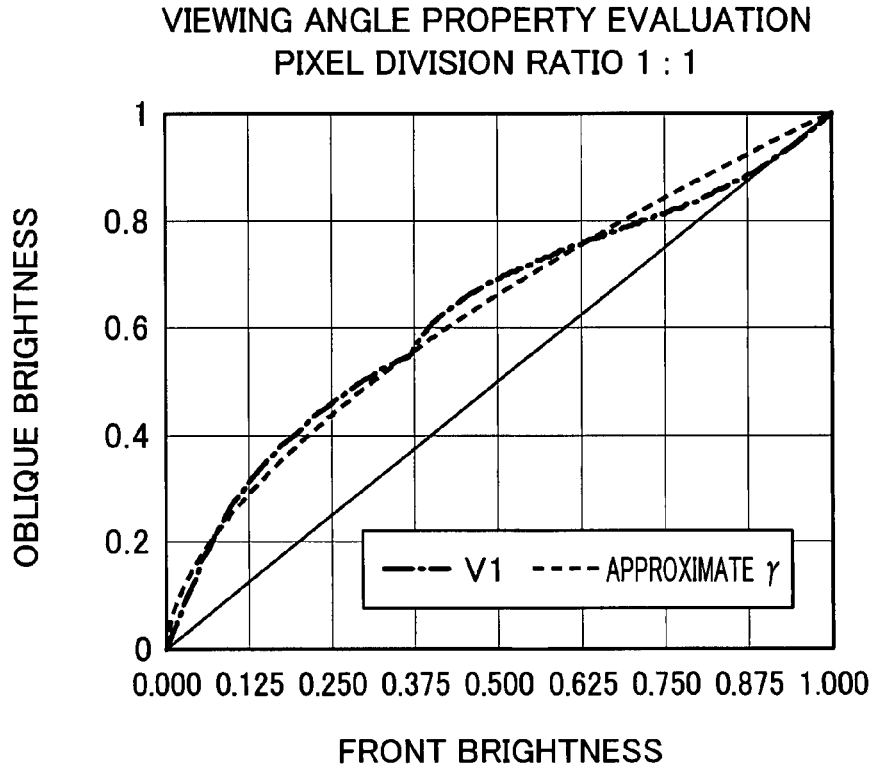
FIG. 18 is a graph illustrating the viewing angle property and an approximate curve thereof in case where a display section (of a liquid crystal panel) of Comparative Example 1 is under a V1 condition.
Figure 19:
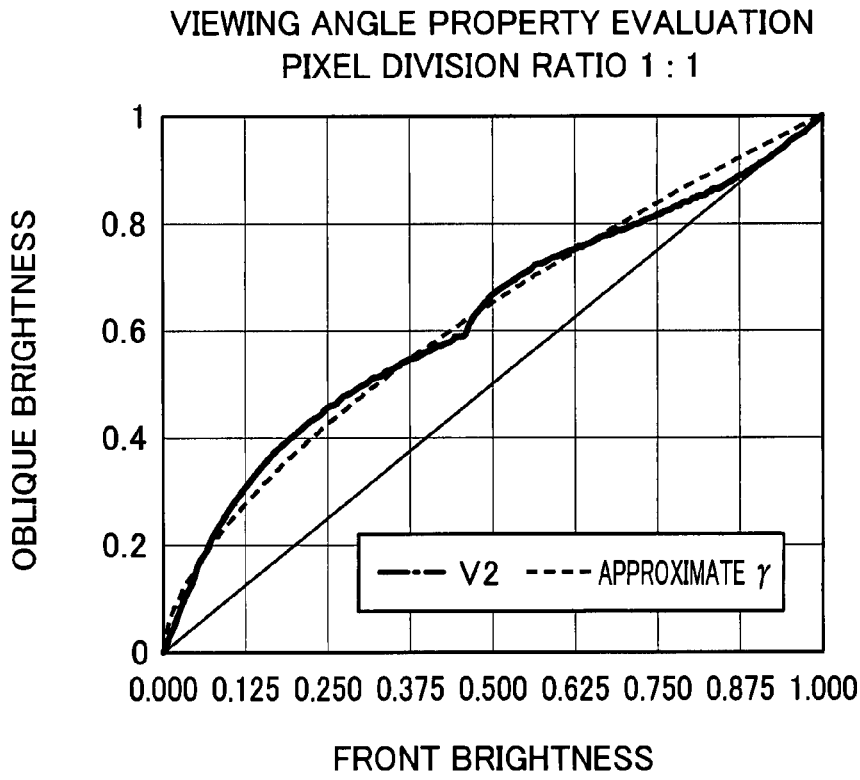
FIG. 19 is a graph illustrating the viewing angle property and an approximate curve thereof in case where the display section (of the liquid crystal panel) of Comparative Example 1 is under a V2 condition.

FIGS. 18 and 19 illustrate liquid crystal panel viewing angle properties in V1 and V2 respectively. In these figures, the approximate curve (approximate γ curve, oblique brightness=x^(n/2.2)) illustrated together with the viewing angle property is calculated from the viewing angle property, and a coefficient is n=1.315 under the condition of V1 and a coefficient is n=1.365 under the condition of V2. The deviation (D value) represents deviation from the approximate curve in the oblique brightness in the viewing angle property under each condition.

As described above, in FIG. 17, V2 seems to have greater inflection than V1, but it is apparent that the inflection in V2 is not necessarily greater than the inflection in V1 if approximate γ curves are actually drawn in V1 and V2. If the deviation is actually calculated, this shows that V2 has smaller deviation than V1. That is, in the liquid crystal panel of the present Comparative Example in which the area division ratio is 1:1, the deviation under the condition of V2 is minimum. The deviation (minimum value) at this time is D=0.0202.

Comparative Example 2

Figure 20:
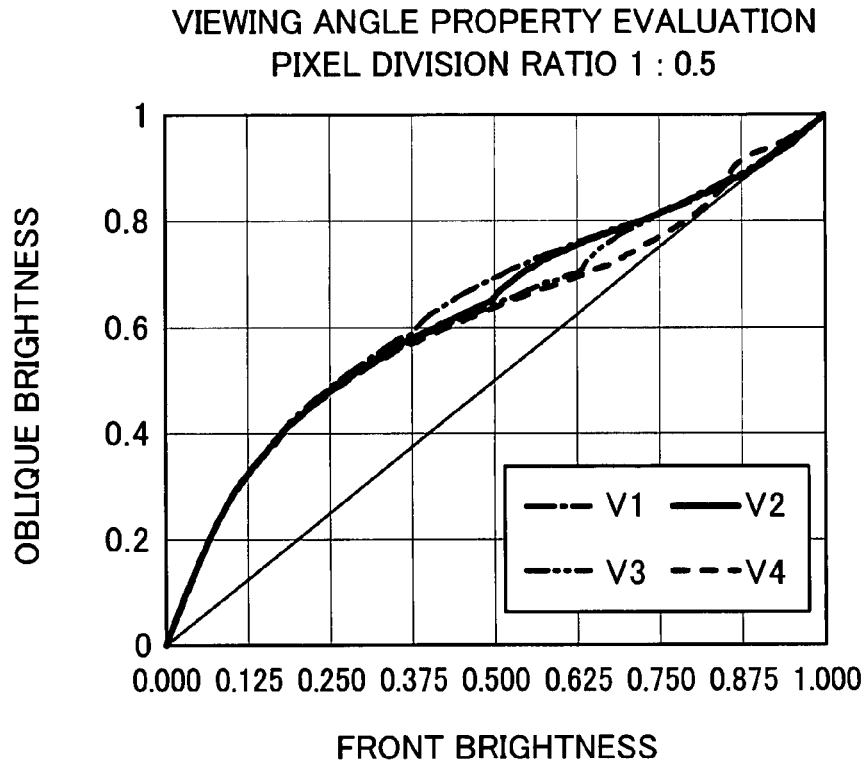
FIG. 20 is a graph illustrating an example of a viewing angle property of a liquid crystal panel which is Comparative Example of the present invention and in which an area division ratio of each pixel is 1:0.5.

With respect to a liquid crystal panel whose area division ratio for each pixel was 1:0.5, the deviation (D value) was calculated in the same manner as in the Comparative Example 1 under four conditions (V1 to V4) respectively. The results thereof are shown in FIG. 20 and Table 3

TABLE 3

| 1:0.5 | D |
|---|---|
| V1 | 0.0268 |
| V2 | 0.0234 |
| V3 | 0.0292 |
| V4 | 0.0374 |

As shown in Table 3, in the liquid crystal panel of the present Comparative Example, a minimum value of the deviation (D value) was D=0.0234 under the condition of V2.

Comparative Example 3

Figure 21:
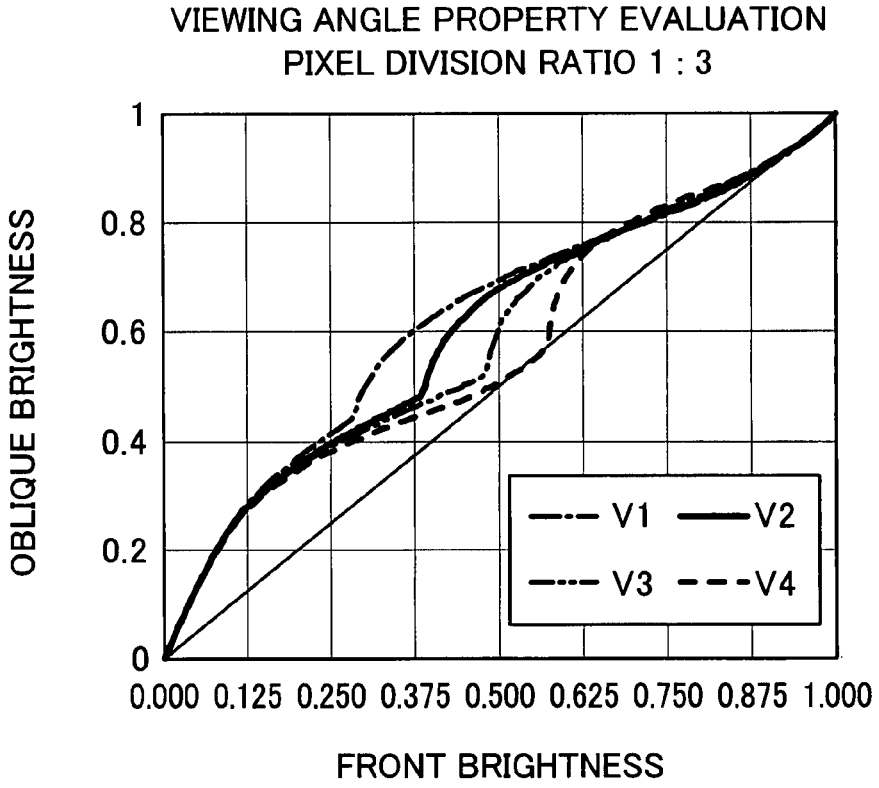
FIG. 21 is a graph illustrating an example of a viewing angle property of a liquid crystal panel which is Comparative Example of the present invention and in which an area division ratio of each pixel is 1:3.

With respect to a liquid crystal panel whose area division ratio for each pixel was 1:3, the deviation (D value) was calculated in the same manner as in the Comparative Example 1 under four conditions (V1 to V4) respectively. The results thereof are shown in FIG. 21 and Table 4.

TABLE 4

| 1:3 | D |
|---|---|
| V1 | 0.0247 |
| V2 | 0.0218 |
| V3 | 0.0248 |
| V4 | 0.0364 |

As shown in Table 4, in the liquid crystal panel of the present Comparative Example, a minimum value of the deviation (D value) was D=0.0218 under the condition of V2.

TABLE 5

| | 1:0.5 | 1:1 | 1:3 |
|---|---|---|---|
| V1 | 0.026 | 0.0223 | 0.0247 |
| V2 | <u>0.0234</u> | <u>0.0202</u> | <u>0.0218</u> |
| V3 | 0.0292 | 0.0291 | 0.0248 |
| V4 | 0.0374 | 0.0405 | 0.0364 |

The minimum value for each pixel division ratio is underlined.

According to the aforementioned Comparative Examples, Table 5 shows that, in the present liquid crystal display panel, a minimum value of the deviation (D value) realized by the area division driving is D=0.0202 (V2 of Comparative Example 1) when the area division ratio is 1:1. Further, the inventors of the present invention confirmed that D=0.0202 of the Comparative Example 1 was substantially the same as those of products on sale. The deviation is not more than the value, products on sale. The deviation is not more than the value, the color deviation in this case is acceptable.

Of course, the viewing angle property of the liquid crystal panel changes if its original property, i.e., a property in case where any area gradation driving is not carried out changes due to a liquid crystal material, a film, and the like. Thus, with these changes, also the deviation (D value) changes in some degree. Note that, in the below-described Examples, the same liquid crystal panel as in the aforementioned Comparative Examples was used, so that the property in case where any area division pixel driving was not carried out was as follows: a difference between each Comparative Example and each Example in the D value was realized by adopting the frame division pixel driving as well as the area division pixel driving.

Example 1

Figure 22:
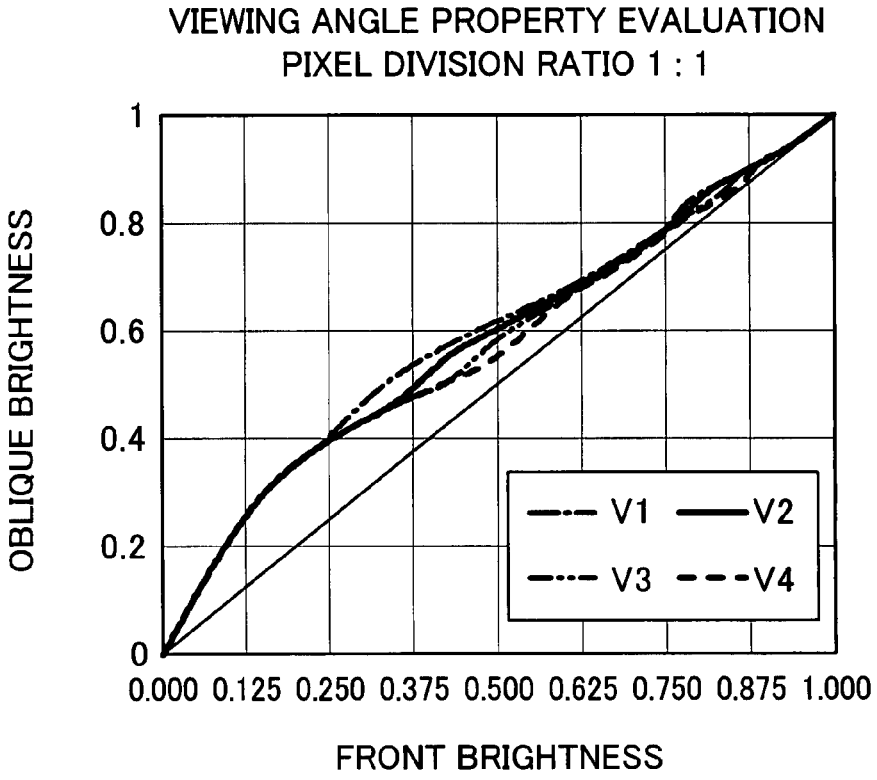
FIG. 22 is a graph illustrating a viewing angle property of a liquid crystal panel (whose pixel division ratio is 1:1 and which corresponds to Comparative Example 1) which is Example of the present invention and in which a control section of the liquid crystal display device is used with a combination of the area division pixel driving and the frame division pixel driving.

FIG. 22 illustrates a graph indicative of a viewing angle property of a liquid crystal display device liquid crystal panel (pixel division ratio is 1:1, corresponding to Comparative Example 1) including a control section adopting both the area division pixel driving and the frame division pixel driving. Each of V1 to V4 shows a result obtained by adjusting a luminance ratio of sub pixels in the same liquid crystal panel as in the aforementioned Comparative Example 1.

TABLE 6

| 1:1 | D |
|---|---|
| V1 | 0.0193 |
| V2 | 0.0170 |
| V3 | 0.0218 |
| V4 | 0.0264 |

As apparent from comparison between Table 6 and Table 1 of Comparative Example 1, the combination with the frame division pixel driving allows the deviation (D value) under all the conditions to be below the value in case of the area division pixel driving. Further, in V1 and V2, there was obtained a value below the minimum value (D=0.020) of the D value obtained in each Comparative Example using only the frame division pixel driving.

Example 2

Figure 23:
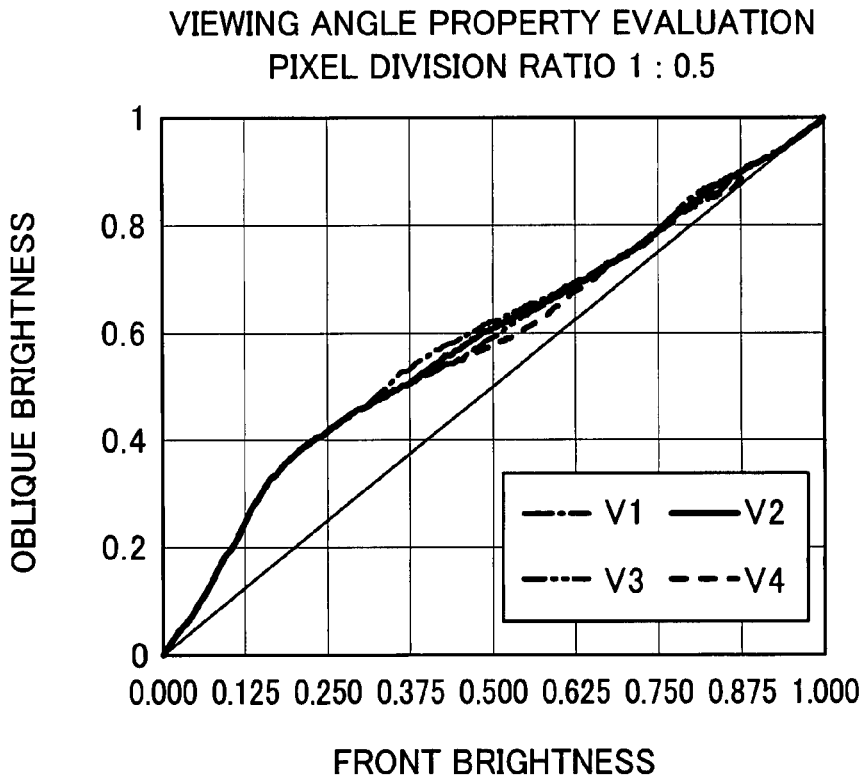
FIG. 23 is a graph illustrating a viewing angle property of a liquid crystal panel (whose pixel division ratio is 1:0.5 and which corresponds to Comparative Example 2) which is Example of the present invention and in which a control section of the liquid crystal display device is used with a combination of the area division pixel driving and the frame division pixel driving.

FIG. 23 is a graph illustrating a viewing angle property of a liquid crystal display device liquid crystal panel (pixel division ratio is 1:0.5, corresponding to Comparative Example 2) including a control section adopting both the area division pixel driving and the frame division pixel driving. Each of V1 to V4 shows a result obtained by adjusting a luminance ratio of sub pixels in the same liquid crystal panel as in the aforementioned Comparative Example 2.

TABLE 7

| 1:0.5 | D |
|---|---|
| V1 | 0.0223 |
| V2 | 0.0213 |
| V3 | 0.0232 |
| V4 | 0.0274 |

As apparent from comparison between Table 7 and Table 3 of Comparative Example 2, the combination with the frame division pixel driving allows the deviation (D value) under all the conditions to be below the value in case of the area division pixel driving.

Example 3

Figure 24:
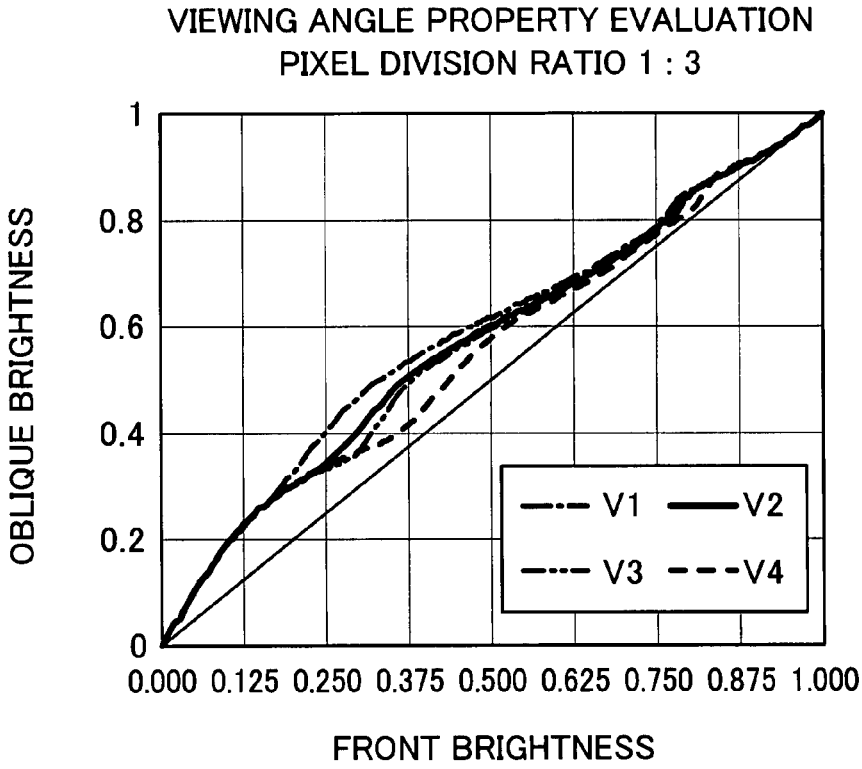
FIG. 24 is a graph illustrating a viewing angle property of a liquid crystal panel (whose pixel division ratio is 1:3 and which corresponds to Comparative Example 3) which is Example of the present invention and in which a control section of the liquid crystal display device is used with a combination of the area division pixel driving and the frame division pixel driving.

FIG. 24 is a graph illustrating a viewing angle property of a liquid crystal display device liquid crystal panel (pixel division ratio is 1:3, corresponding to Comparative Example 3) including a control section adopting both the area division pixel driving and the frame division pixel driving. Each of V1 to V4 shows a result obtained by adjusting a luminance ratio of sub pixels in the same liquid crystal panel as in the aforementioned Comparative Example 3.

TABLE 8

| 1:3 | D |
|---|---|
| V1 | 0.0180 |
| V2 | 0.0129 |
| V3 | 0.0142 |
| V4 | 0.0167 |

As apparent from comparison between Table 8 and Table 4 of Comparative Example 3, the combination with the frame division pixel driving allows the deviation (D value) under all the conditions to be below the value in case of the area division pixel driving. Further, also in V1 to V4, there was obtained a value below the minimum value (D=0.020) of the D value obtained in each Comparative Example using only the frame division pixel driving.

As shown by the comparison between Examples 1 to 3 with Comparative Examples 1 to 3, it is possible to reduce the deviation (D value) by combining the frame division pixel driving with the liquid crystal panel having the same pixel division ratio. By providing a liquid crystal panel whose deviation (D value) is small in this manner, it is possible to suppress occurrence of the aforementioned color deviation compared with the conventional arrangement.

Further, under all the conditions, the D value of the liquid crystal panel whose pixel division ratio is 1:3 was below the minimum value obtained in using only the area division pixel driving. In case of adopting both the pixel division pixel driving and the division pixel driving in this manner, unlike the case of carrying out the control by using only the pixel division pixel driving, it is possible to suppress the color deviation by changing the pixel division ratio. It is particularly preferable that the pixel division ratio is about 1:3.

Figure 25:
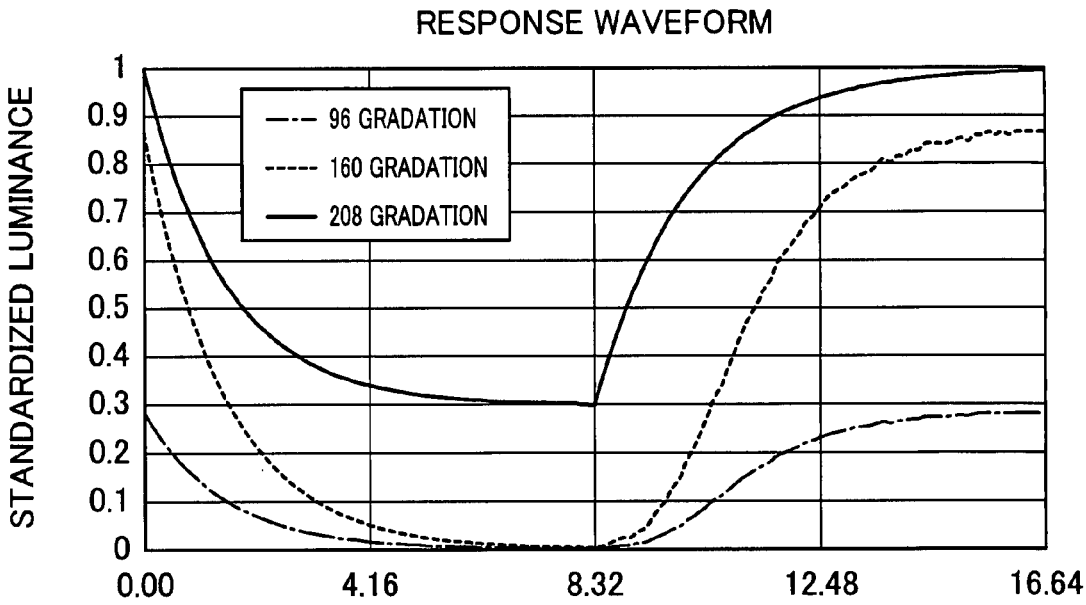
FIG. 25 is a graph illustrating a response property of the liquid crystal panel used in Examples 1 to 3 of the present invention.

In the aforementioned Examples and Comparative Examples, the liquid crystal panel using the liquid crystal response property illustrated in FIG. 25 was used. The liquid crystal response property illustrated in FIG. 25 was a typical liquid crystal response in a VA mode (general liquid crystal mode). A response speed is a value unique to a liquid crystal panel, so that the value was not used in the aforementioned Examples as an adjustment parameter. However, the deviation (D value) exists also in the response speed of the liquid crystal used in the liquid crystal panel. The following mentions this point.

Figure 26:
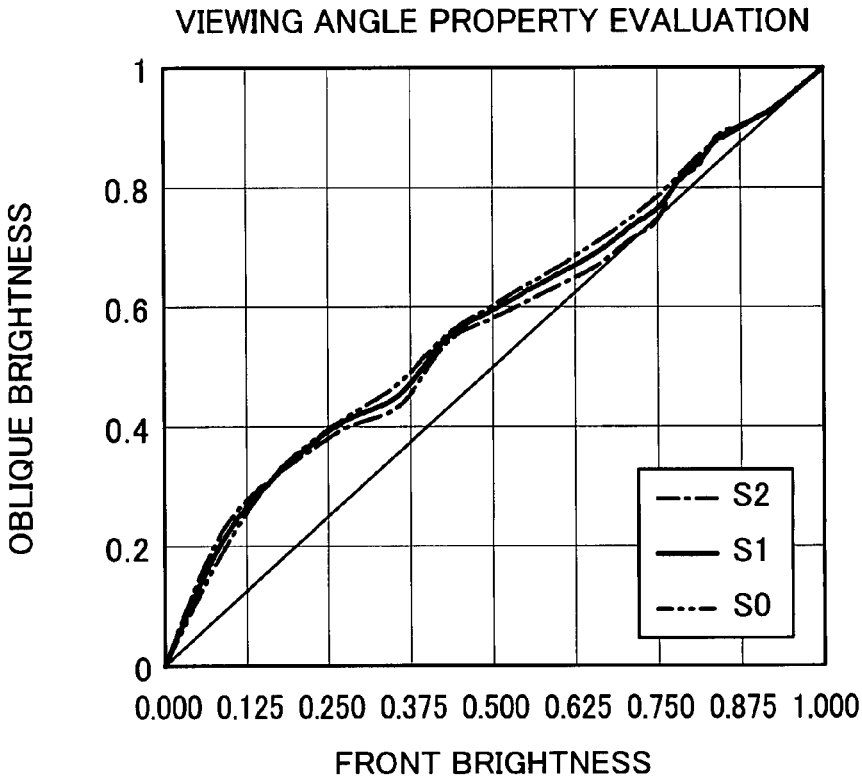
FIG. 26 is a graph illustrating how deviation (D value) varies depending on a liquid crystal response speed of the liquid crystal panel.
Figure 27:
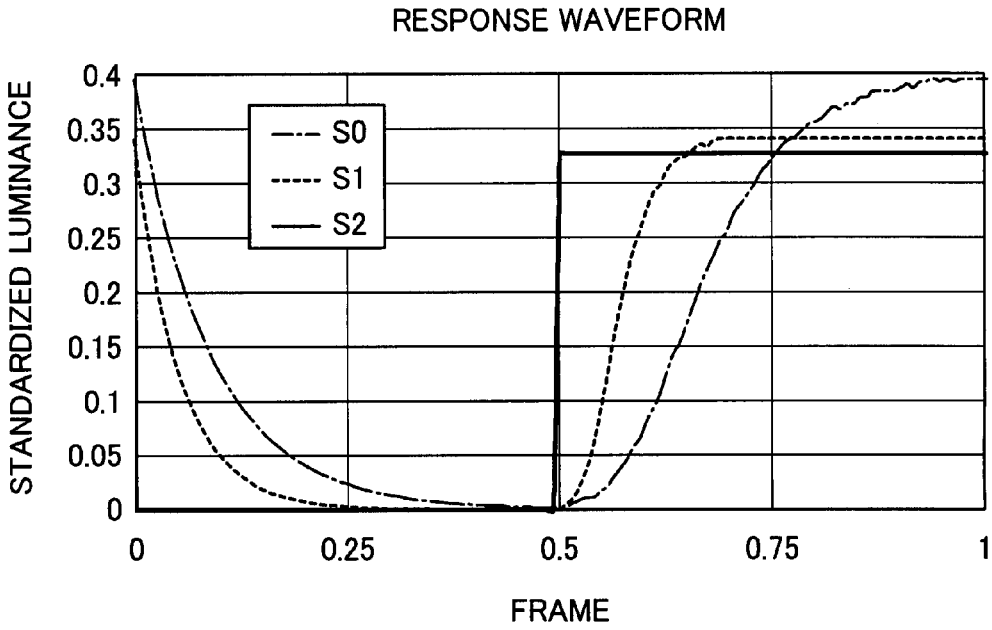
FIG. 27 is a graph illustrating a response waveform corresponding to FIG. 26.
Figure 28:
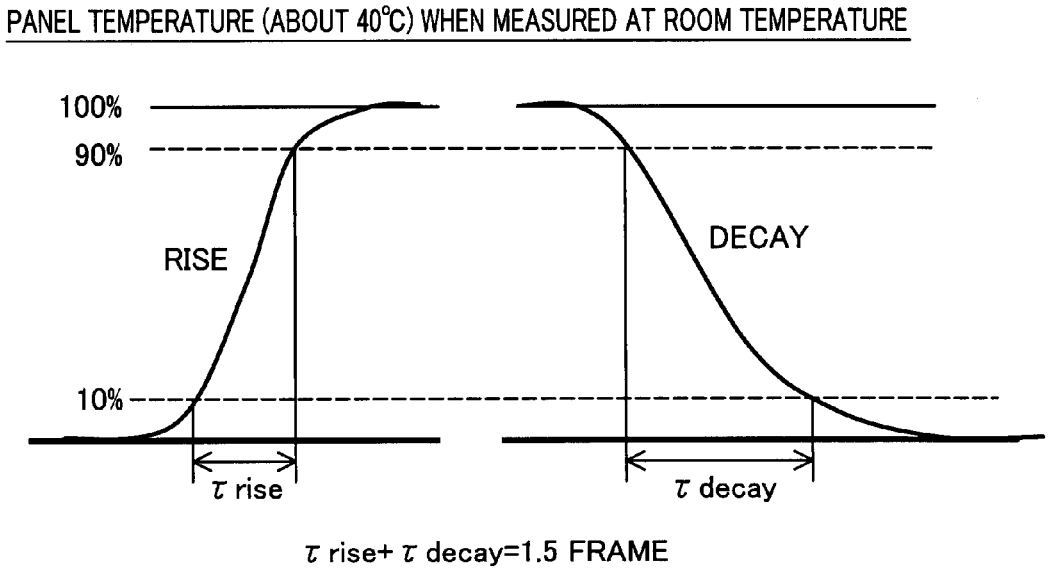
FIG. 28 is a graph illustrating a liquid crystal response speed of the liquid crystal panel provided by the present invention.
Figure 29:
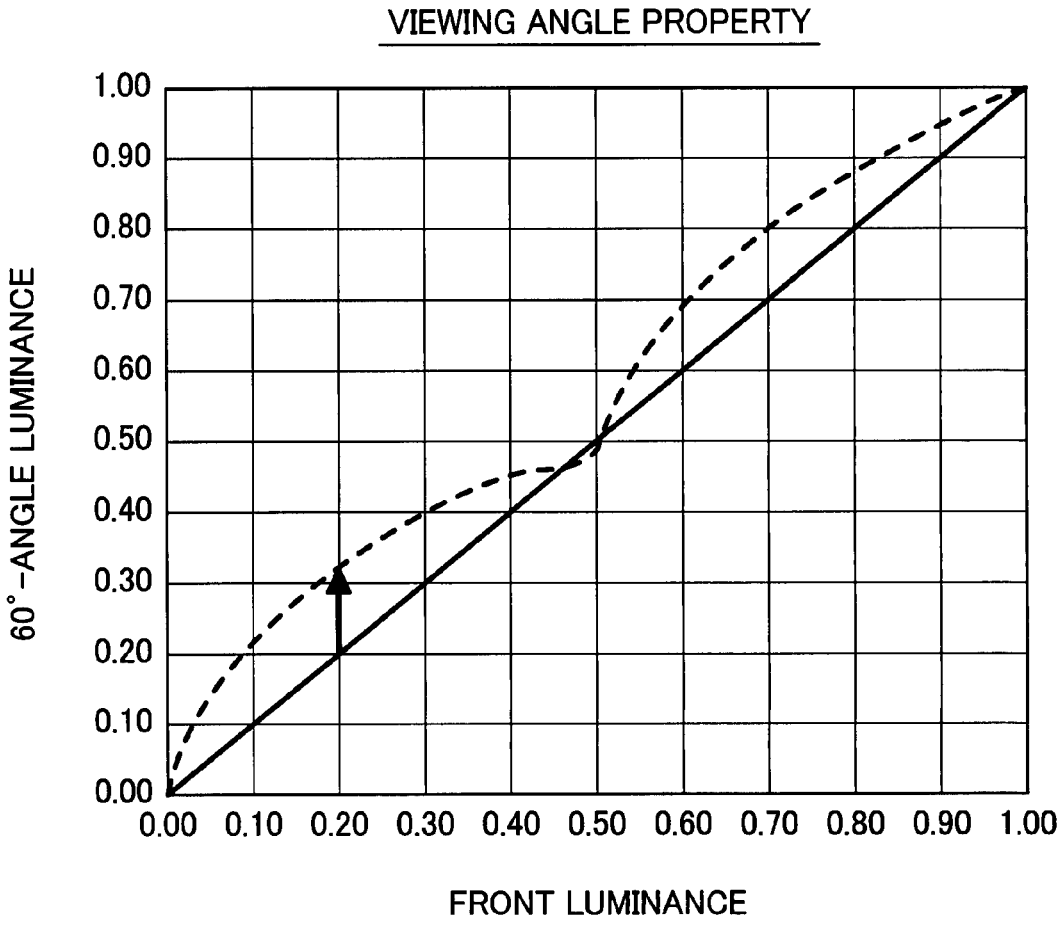
FIG. 29, showing a conventional technique, is a graph illustrating a viewing angle property so that a horizontal axis indicates front luminance in viewing an image display device from a front direction and a vertical axis indicates oblique luminance in viewing the image display device from an oblique direction.

Each of FIG. 26 and Table 9 shows how the deviation varies. A response waveform corresponding to FIG. 26 is illustrated in FIG. 27.

TABLE 9

| | D |
|---|---|
| S0 | 0.0170 |
| S1 | 0.0224 |
| S2 | 0.0290 |

In case where the response speed of the liquid crystal is maximum, the deviation is great in a square wave. As the response speed of the liquid crystal becomes lower, the deviation becomes smaller. Adversely, if the response speed of the liquid crystal is too slow, it is impossible to respond in each frame, so that the luminance cannot be made varied. As a result, it is substantially impossible to obtain the effect of the frame division pixel driving.

That is, the driving is carried out only by the area division pixel driving without carrying out the frame division pixel driving. As a result, also the deviation becomes approximate to a value of the area gradation driving. The frame division driving was carried out with respect to a liquid crystal panel arranged so that a total of a rise time (10%-90%) and a decay time (90%-10%) at a panel temperature (about 40° C.), at least during room temperature driving, was within 1.5 frames.

Further, as described above, the liquid crystal panel whose liquid response speed is high has great deviation. However, by adopting the amplitude of the CS voltage, the adjustment of the pixel area ratio, the adjustment of the below-described time division ratio, and the table adjustment, all of which are proposed in the present invention, it is possible to make the deviation smaller.

Industrial Applicability

The present invention is favorably applicable to a device having a display screen in which color deviation occurs.

The invention claimed is:

1. A display device, comprising:

a display section which includes a pixel having a first sub pixel and a second sub pixel and displays an image whose luminance is based on a luminance gradation of an inputted display signal; and a control section which causes luminance of the first sub pixel and luminance of the second sub pixel to be different from each other and generates a first display signal serving as a display signal in a first sub frame and a second display signal serving as a display signal in a second sub frame so that division of a frame does not change total luminance outputted from the display section in a single frame, so as to output the first and second display signal to the display section, wherein the display section is arranged so that a first integral value obtained by carrying out steps (a) to (d) is not more than 0.0202, the step (a) of measuring surface luminance of the display section and oblique luminance of the display section viewed at an angle of 60° with respect to a front direction of the display section, the step (b) of standardizing the front luminance and the oblique luminance so as to calculate front standardized brightness x and oblique standardized brightness, the step (c) of determining n of x^(n/2.2) so that an integral value of a difference between x^(n/2.2) and the front standardized brightness x is equal to an integral value of a difference between the oblique standardized brightness and the front standardized brightness x, the step (d) of integrating an absolute value of a difference between x^(n/2.2) and the oblique standardized brightness, from minimum luminance to maximum luminance of the front standardized brightness x, so as to the first integral value, wherein the control section adjusts a ratio of sub frames, obtained by dividing the frame, so as to adjust the first integral value.

2. The display device as set forth in claim 1, wherein the display section is a liquid crystal panel.

3. The display device as set forth in claim 1, wherein the first integral value obtain in the steps (a) to (d) is not more than 0.015.

4. The display device as set forth in claim 1, wherein n obtained in the step (c) is not less than 1.75.

5. The display device as set forth in claim 1, wherein:

the first integral value obtain in the steps (a) to (d) is not more than 0.015, and n obtained in the step (c) is not less than 1.75.

6. The display device as set forth in claim 1, wherein the display section is arranged so that the first integral value is adjusted by adjusting an area ratio of the first sub pixel and the second sub pixel.

7. The display device as set forth in claim 1, wherein the display section is arranged so that the first integral value is adjusted by adjusting distribution of a signal to the first sub pixel and the second sub pixel.

8. An adjustment method of a display device which includes:

a display section which includes a pixel having a first sub pixel and a second sub pixel and displays an image whose luminance is based on a luminance gradation of an inputted display signal; and a control section which causes luminance of the first sub pixel and luminance of the second sub pixel to be different from each other and generates a first display signal serving as a display signal in a first sub frame and a second display signal serving as a display signal in a second sub frame so that division of a frame does not change total luminance outputted from the display section in a single frame, so as to output the first and second display signal to the display section, said adjustment method comprising the steps of:

measuring surface luminance of the display section and oblique luminance of the display section viewed at 60° from a front direction of the display section;

standardizing the front luminance and the oblique luminance so as to calculate front standardized brightness x and oblique standardized brightness;

determining n of x^(n/2.2) so that an integral value of a difference between x^(n/2.2) and the front standardized brightness x is equal to an integral value of a difference between the oblique standardized brightness and the front standardized brightness x; and integrating an absolute value of a difference between x^(n/2.2) and the oblique standardized brightness, from minimum luminance to maximum luminance of the front standardized brightness x, so that a first integral value obtained by the integration is not more than 0.0202, wherein a ratio of sub frames, obtained by dividing the frame, is adjusted so as to adjust the first integral value.

9. The adjustment method as set forth in claim 8, wherein adjustment is carried out so that the first integral value obtained by integrating an absolute value of a difference between x^(n/2.2) and the oblique standardized brightness, from the minimum luminance to the maximum luminance of the front standardized brightness x, is not more than 0.015 and n that has been determined is not less than 1.75.

10. The adjustment method as set forth in claim 8, wherein the first integral value is adjusted by adjusting an area ratio of the first sub pixel and the second sub pixel.

11. The adjustment method as set forth in claim 8, wherein the first integral value is adjusted by adjusting distribution of a signal to the first sub pixel and the second sub pixel.

12. The adjustment method as set forth in claim 8, wherein luminance gradations of the first and second display signals of the control section are adjusted.

13. An image display monitor, comprising:

the display device as set forth in claim 1; and a signal input section for transmitting an image signal, inputted from an outside, to the display device.

14. A television receiver, comprising:

the display device as set forth in claim 1; and a tuner section for selecting a channel of a television broadcasting signal so as to transmit a television image signal of the selected channel to the image display device.

* * * * *